US005730305A

United States Patent [19]

Ichiba et al.

[11] Patent Number: 5,730,305

[45] Date of Patent: Mar. 24, 1998

[54] CRANE SAFETY APPARATUS

[75] Inventors: Akinori Ichiba, Satte; Yukio Tsutsumi, Saitama, both of Japan

[73] Assignee: Kato Works Co., Ltd., Tokyo, Japan

[21] Appl. No.: 333,243

[22] Filed: Nov. 2, 1994

Related U.S. Application Data

[60] Continuation of Ser. No. 2,537, Jan. 8, 1993, abandoned, which is a division of Ser. No. 571,521, filed as PCT/JP89/00368, Apr. 6, 1989 published as WO90/07465, Jul. 12, 1990, abandoned.

[30] Foreign Application Priority Data

Dec. 27, 1988 [JP] Japan ..... 63-330197

[51] Int. Cl.[6] ..... B66C 13/16; B66C 13/18

[52] U.S. Cl. ..... 212/276; 212/277; 212/280; 212/281

[58] Field of Search ..... 364/463, 464; 340/438, 289, 940, 525, 306, 685, 686, 984; 37/DIG. 1, DIG. 20; 414/394; 212/276–281, 284

[56] References Cited

U.S. PATENT DOCUMENTS

| | | | |
|---|---|---|---|
| 3,893,093 | 7/1975 | Paredes et al. . | |
| 3,993,986 | 11/1976 | Honda . | |
| 4,216,868 | 8/1980 | Geppert | 212/155 |
| 4,376,298 | 3/1983 | Sokol et al. | 340/684 |
| 4,395,706 | 7/1983 | Garber . | |
| 4,504,918 | 3/1985 | Axmann . | |
| 4,511,974 | 4/1985 | Nakane et al. | 414/634 |
| 4,516,116 | 5/1985 | White | 340/685 |
| 4,516,117 | 5/1985 | Couture et al. | 212/151 |
| 4,616,328 | 10/1986 | Kassay et al. | 340/684 |
| 4,633,383 | 12/1986 | Omachi et al. | 414/394 |
| 4,752,012 | 6/1988 | Juergens | 340/685 |
| 4,831,548 | 5/1989 | Matoba et al. | 901/47 |
| 4,833,615 | 5/1989 | Bitner et al. | 340/685 |

FOREIGN PATENT DOCUMENTS

| | | | |
|---|---|---|---|
| 0 008 210 | 2/1980 | European Pat. Off. . | |
| 216699 | 12/1984 | German Dem. Rep. | 212/232 |
| 56-75393 | 6/1981 | Japan . | |
| 56-149995 | 11/1981 | Japan . | |
| 56-47117 | 11/1981 | Japan . | |
| 58-74496 | 5/1983 | Japan . | |
| 128195 | 12/1983 | Japan . | |
| 59-53388 | 3/1984 | Japan . | |
| 60-128195 | 7/1985 | Japan . | |
| 60-126491 | 8/1985 | Japan . | |
| 61-119585 | 7/1986 | Japan . | |

(List continued on next page.)

OTHER PUBLICATIONS

Notice of Opposition by Deutsche Grove GmbH, Dated 28, Mar. 1996.

Notice of Opposition by Liebherr–Werk Ehingen GmbH, Dated 21, Mar. 1996.

Liebherr Operating Instructions Manual, Jan. 1970.

Bergbau Journal (E1) Jun. 1990, p. 287 and Translation.

Krupp Brochure (E2) and Electronsicke Kran–Sicherlert-seinaichtung fur Autokrane (E3) Apr. 1985 and Translation.

"Tele–Truk" company magazine (E4) May 1984 and Partial Translation.

*Primary Examiner*—Karen B. Merritt
*Assistant Examiner*—R. B. Johnson
*Attorney, Agent, or Firm*—Fish & Richardson P.C.

[57] ABSTRACT

A crane safety apparatus for displaying a schematic diagram of a part of a crane mechanism on a two-dimensional screen dynamically as the crane mechanism is operated, and displaying on the same screen a predetermined operation zone as a visually discriminative zone pattern. The operation zone pattern is displayed on the screen in response to the key command by an operator during a selected crane operation mode, while referring to the schematic crane mechanism diagram currently displayed on the screen.

2 Claims, 19 Drawing Sheets

FOREIGN PATENT DOCUMENTS

| | | | |
|---|---|---|---|
| 61-27896 | 7/1986 | Japan . | |
| 62-136497 | 6/1987 | Japan . | |
| 1125183 | 1/1978 | U.S.S.R. | 212/149 |
| 1040098 | 7/1984 | U.S.S.R. | 212/149 |
| 1104096 | 7/1984 | U.S.S.R. | 212/151 |
| 1104097 | 7/1984 | U.S.S.R. | 212/152 |
| 1104099 | 7/1984 | U.S.S.R. | 212/149 |
| 2 050 294 | 1/1981 | United Kingdom . | |
| WO 85/05614 | 12/1985 | WIPO . | |

RADIUS LIMITATION
(A)

LIFTING DISTANCE LIMITATION
(D)

HIGH ANGLE LIMITATION
(B)

ALLOWABLE OPERATION ZONE
(E)

LOW ANGLE LIMITATION
(C)

(F)

(G)

SLEWING ANGLE LIMITATION

□ 8.9m - 28.5m BOOM

| OPERATION RADIUS | OUTRIGGER MAXIMUM STATUS (ALL SLEWING) | | | | OUTRIGGER INTERMIDIATE STATUS (5.0m) (SIDE) | | | | OUTRIGGER INTERMIDIATE STATUS | | |
|---|---|---|---|---|---|---|---|---|---|---|---|
| | 8.9m BOOM | 15.43m BOOM | 21.97m BOOM | 28.5m BOOM | 8.9m BOOM | 15.43m BOOM | 21.97m BOOM | 28.5m BOOM | 8.9m BOOM | 15.43m BOOM | 21.97m BOOM |
| 2.5 | 25.00 | 19.50 | | | 25.00 | 19.50 | | | 25.00 | 19.50 | |
| 3.0 | 25.00 | 19.50 | | | 25.00 | 19.50 | | | 25.00 | 19.50 | |
| 3.5 | 25.00 | 19.50 | 12.50 | | 25.00 | 19.50 | 12.50 | | 19.60 | 19.50 | 12 |
| 4.0 | 23.00 | 19.50 | 12.50 | | 23.00 | 19.50 | 12.50 | | 15.55 | 15.60 | 1 |
| 4.5 | 21.20 | 18.00 | 12.50 | | 21.20 | 18.00 | 12.50 | | 12.65 | 12.60 | |
| 5.0 | 19.40 | 16.70 | 12.50 | 8.00 | 18.10 | 16.70 | 12.50 | 8.00 | 10.60 | 10.30 | |
| 5.5 | 17.80 | 15.50 | 11.70 | 8.00 | 15.35 | 14.20 | 11.70 | 8.00 | 9.05 | 6 | |
| 6.0 | 16.30 | 14.40 | 11.00 | 8.00 | 12.90 | 12.30 | 11.00 | 8.00 | 7.70 | | |
| 6.5 | 15.10 | 13.40 | 10.40 | 8.00 | 11.10 | 10.65 | 10.40 | 8.00 | 6 | | |
| 7.0 | | 12.55 | 9.80 | 7.60 | | 9.25 | 9.80 | 7.60 | | | |
| 8.0 | | 10.55 | 8.70 | 6.90 | | 7.20 | 7.80 | 6.90 | | | |
| 9.0 | | 8.45 | 7.70 | 6.20 | | 5.75 | 6.45 | 6.20 | | | |
| 10.0 | | 6.95 | 6.90 | 5.65 | | 4.70 | 5.35 | 5.55 | | | |
| 11.0 | | 5.75 | 6.25 | 5.15 | | 3.90 | 4.50 | 4.75 | | | |
| 12.0 | | 4.85 | 5.40 | 4.70 | | 3.30 | 3.80 | 4.10 | | | |
| 13.0 | | 4.10 | 4.65 | 4.30 | | 2.75 | 3.25 | 3 | | | |
| 14.0 | | | 4.05 | 4.00 | | | 2.80 | | | | |
| 15.0 | | | 3.55 | 3.70 | | | | | | | |
| 16.0 | | | 3.10 | 3.35 | | | | | | | |
| 17.0 | | | 2.75 | 3.00 | | | | | | | |
| 18.0 | | | 2.45 | 2.70 | | | | | | | |
| 19.0 | | | 2.15 | 2.40 | | | | | | | |
| 20.0 | | | | | | | | | | | |
| 22 | | | | | | | | | | | |

(SPECIFIC TOTAL LOAD TABLE)

(MAIN FLOW OF MAIN UNIT)

(INTERRUPT FLOW OF MAIN UNIT)

(SOFT INTERRUPT)

(MAIN FLOW OF DISPLAY UNIT)

(DISPLAY UNIT INTERRUPT)

CRANE SAFETY APPARATUS

This is a continuation of application Ser. No. 08/002,537, filed on Jan. 8, 1993, now abandoned, which is a divisional application of U.S. Ser. No. 07/571,521, filed as PCT/JP89/00368, Apr. 6, 1989 published as WO90/07465, Jul. 12, 1990, now abandoned.

FIELD OF THE INVENTION

The present invention relates to a crane safety apparatus, and more particularly to a crane safety apparatus having a plurality of image display modes and capable of providing an operator with crane operation status settings and safe operation in accordance with a selected image display mode.

BACKGROUND OF THE INVENTION

There has been proposed a crane safety apparatus (Japanese Patent Publication No. 56-47117). According to the function of this crane safety apparatus, various operation parameters (boom length, boom angle, outrigger projection, jib setting, and the like) for determining the operation status of a crane are detected with sensors. A specific load for the operation status determined by these operation parameters is read from a digital memory which stores therein specific loads for various operation conditions, the specific load being determined in accordance with the specification of a crane. The accessed specific load is compared with the current actual load. If the actual load nears the specific load, a warning is issued, and if it becomes equal to the specific load, the crane operation is automatically stopped. A conventional crane safety apparatus of this type has an indication panel such as shown in FIG. 1. The operation status such as crane outrigger projection, jib setting and the like is set by using switches mounted on the indication panel so that values representative of the current boom length, angle and the like are displayed from time to time. A safety meter is mounted on the upper portion of the indication panel. The safety meter displays in the form of a bar graph the degree of safety of an actual load relative to the specific load for the current crane operation status.

Such a conventional technique provides warning and automatic stop to prevent the possible overturn, collapse, or failure of a crane. However, it does not provide a function to regulate the operation range of a crane when considering other buildings or the like.

Japanese Patent Laid-open Publication No. 58-74496 discloses a method of regulating the operation range of a tower type crane. According to this method, a crane boom and an obstacle are schematically displayed on a screen so that it is possible to detect any contact between the boom and the obstacle schematically displayed on the screen. In this case, however, for the display of an obstacle, the coordinates of the obstacle on the screen are required to be correctly set, which is not a simple initial setting of the operation range.

Further, such a conventional technique does not provide a function to ensure proper and safe operation at the operation site which an operator can visually recognize.

Another problem associated with such a conventional technique is that only the safety degree of an actual load relative to the specific load, i.e., the safety degree of actual operation, is provided. As a result, an operator cannot recognize sufficiently the danger for the next possible stage and operation.

Furthermore, such a conventional technique does not provide a function to selectively display a pattern to be used for a proper crane operation suitable for particular operation contents.

SUMMARY OF THE INVENTION

The crane safety apparatus of this invention has a memory which stores therein display images for a plurality of crane operation modes. The display image selected by an operator is controlled to indicate the current crane operation status in accordance with the crane operation parameters and operator setting data.

The crane safety apparatus of this invention comprises a schematic crane mechanism diagram displaying means for displaying a schematic diagram of a part of the crane mechanism on a screen at the coordinate position determined by signals from sensors, and means including a key group for fixedly displaying a predetermined zone pattern on the screen relative to the already displayed schematic diagram, in accordance with the crane operation status setting entered by an operator by using a key.

In a preferred embodiment of the crane safety apparatus of this invention, while monitoring the safety degree of a crane, a schematic diagram of a part of the crane mechanism is dynamically displayed on the screen. There are provided a main unit CPU and display unit CPU which each take partial charge of the operations necessary for the apparatus, to thereby allow a dynamic display of the schematic diagram of the crane mechanism on the screen while tracing a change in operation of the mechanism at high speed.

DETAILED DESCRIPTION

Fundamental Structure of Apparatus

Figure 1:
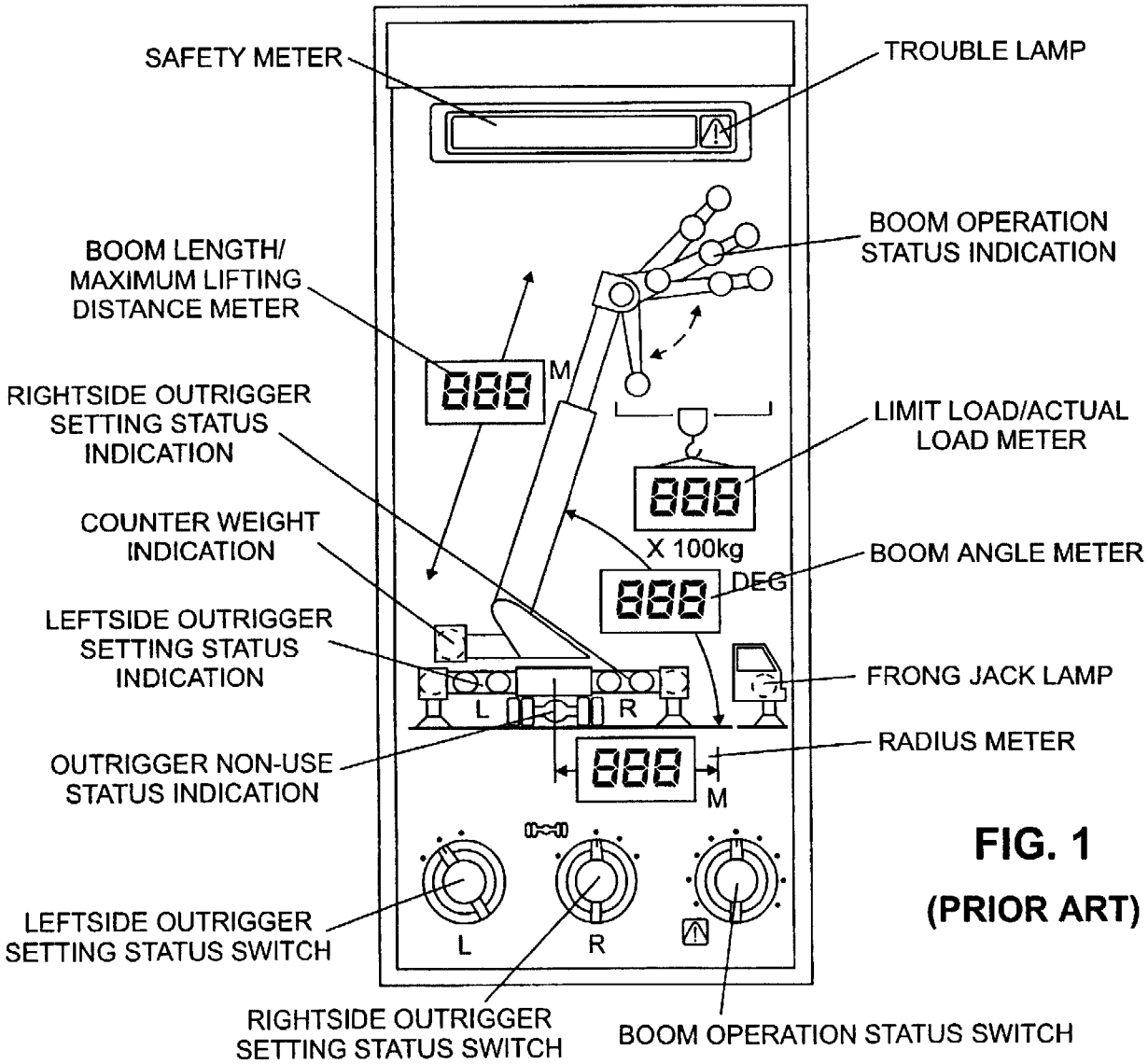
FIG. 1 (PRIOR ART)
FIG. 1 shows an example of an indication panel of a conventional crane safety apparatus.
Figure 2A:
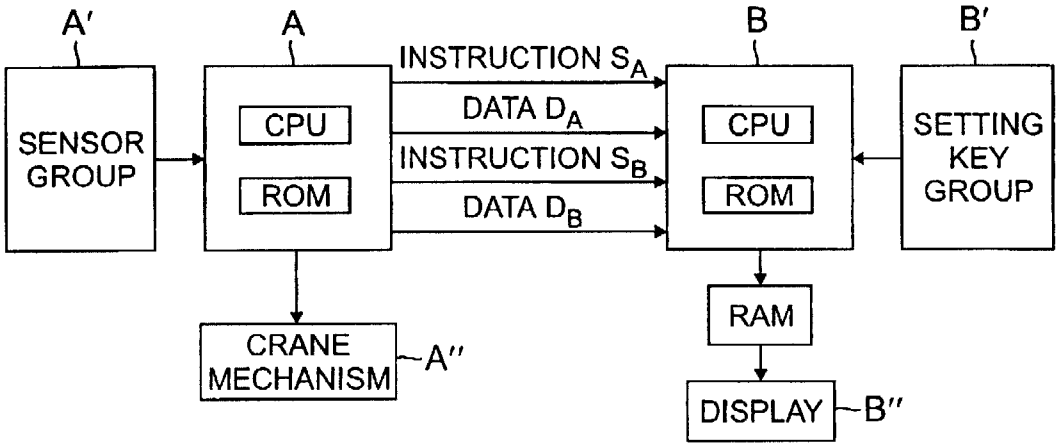
FIG. 2A is a block diagram showing the fundamental structure of the apparatus according to this invention.

The fundamental structure of the crane safety apparatus of this invention is shown in FIG. 2A. The crane safety apparatus is constructed of a main unit A and a display unit B. During the operation of the apparatus, commands and data are transferred between a main unit CPU and a display unit CPU.

Figure 3:
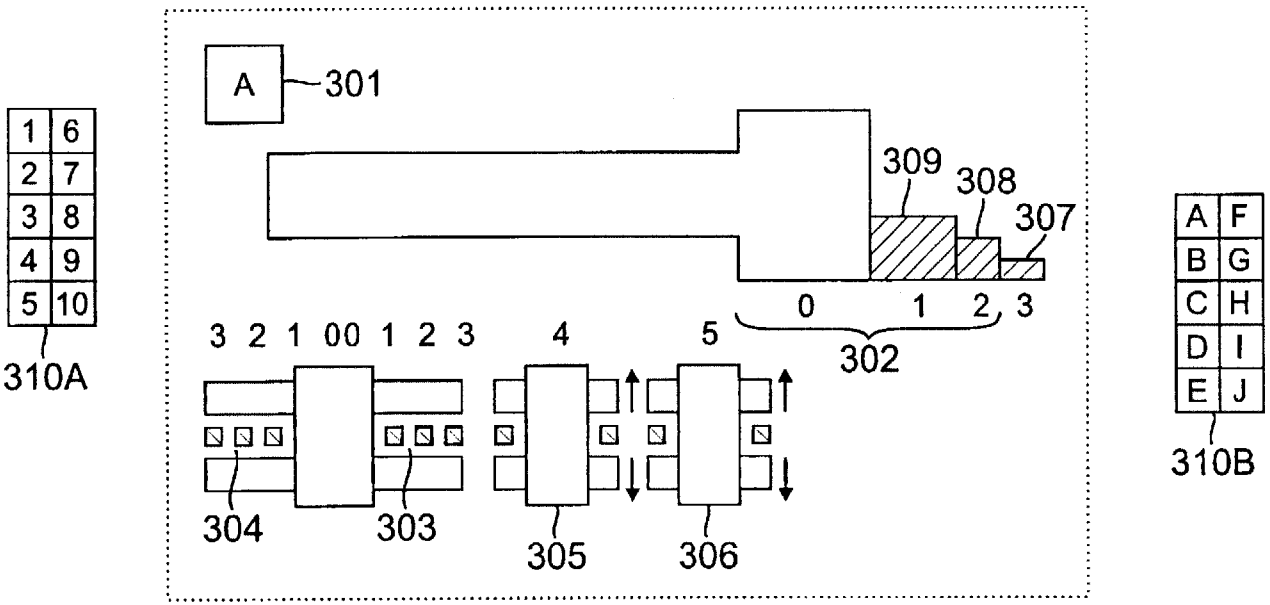
FIG. 3 shows a display pattern on the screen during an operation status setting mode according to the apparatus of this invention.

Upon power-on, the crane operation status (outrigger projection step, jib step and the like) is first required to be set. This setting is carried out at the display unit. An operator selects an operation status setting mode from a plurality of display modes to display a display indication (image) such as shown in FIG. 3 on a display B" (see FIG. 2A) screen, and operates predetermined keys on a setting key group B' while monitoring the display B" screen. The display unit has a memory which stores therein graphics data for display images such as that shown in FIG. 3. In accordance with a display control program in a ROM, the display unit CPU selectively reads a display image shown in FIG. 3 from the memory, writes it in a video RAM, and displays the display image on the display B" screen in accordance with the data read from the video RAM. The display unit CPU fetches the data of outrigger step setting and the like entered from a setting key by an operator, modifies the display image so as to match the setting data, and supplies the setting data as data $D_B$ to the main unit A. Upon completion of the operation status setting mode, the display unit enters an automatic crane safety monitor mode and displays a display image such as that shown in FIG. 4A on the display B" screen. The graphics data for the display image such as that shown in FIG. 4A have already been stored in the memory, so the display unit CPU executes a selective read and display of the graphics data.

In addition to the crane operation status setting data $D_B$ supplied from the display unit B, the main unit A obtains from a sensor group A' the operation parameter data (such as boom length l, boom angle θ, slewing angle ϕ) representative of the operation status of the crane mechanism which changes from time to time as the crane is operated. These operation parameters are sent directly, or after processed by the main unit CPU, to the display unit B as data $D_A$. The display unit B modifies from time to time the display image on the display B" screen in accordance with the data $D_A$, to thereby display the current operation status of the crane.

Figure 2B:
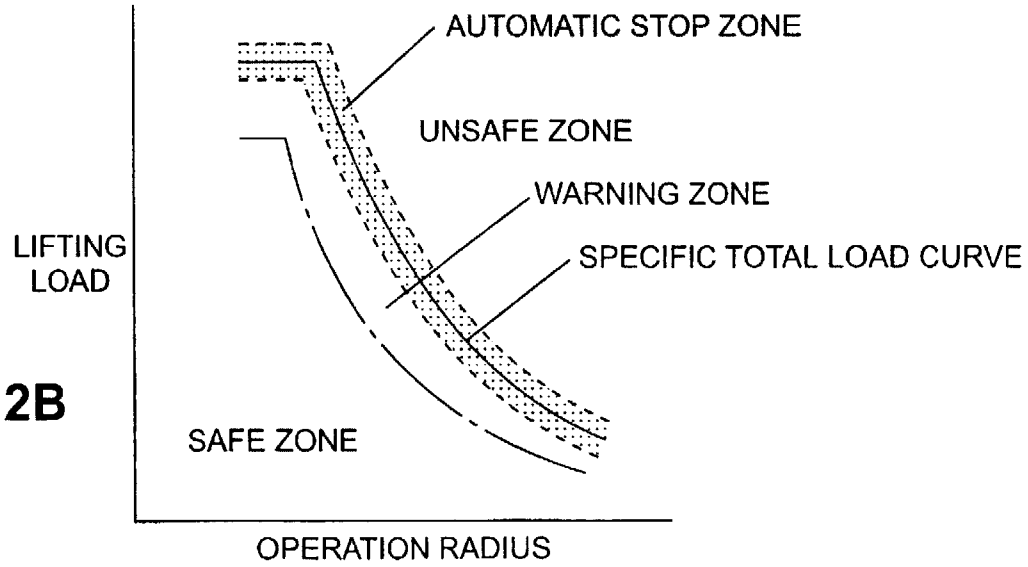
FIG. 2B shows an example of a specific load data curve stored in the apparatus of this invention.

The main unit A stores various data in accordance with each crane specification. Such data are typically maximum specific loads for various crane operation status. For example, a total specific load curve shown in FIG. 2B is used for the operation status settings, for example, an outrigger intermediate projection of 5.0 m (-side direction), without jib, and with boom length of 8.9 m. Such a total specific load curve is determined for each of the different operation status settings and boom lengths, in accordance with each crane specification. A great number of these data are stored in ROM of the main unit A.

In accordance with the crane operation status setting data $D_B$ supplied from the display unit B and the crane operation status parameters changing with time supplied from the sensor group A', the main unit A accesses ROM to obtain the maximum specific load data for the crane operation status at that time, and compares the maximum load value obtained by processing the data with the actual load. If the current crane operation status is in a danger zone a warning is issued, and/or a signal is generated for controlling the crane mechanism A" for automatic stop of the crane operation.

In the memory of the display unit B, there are stored a plurality of display image graphics data corresponding to a plurality of display modes. A display image, such as shown in FIGS. 5 to 8 and 9B, is selected in accordance with the display mode selected by a setting key. In addition to the automatic crane safety monitor display mode shown in FIG. 4A conventionally provided in general, an operator can use other display modes to set the operation contents of a crane and monitor it for effective crane operation. The operation of other display modes will be later detailed.

The main unit A and display unit B each have a processor (CPU), which runs independently on its own program. Transmission/reception of commands and data between the main unit A and display unit B is allowed by an interrupt process.

Particular Structure of Apparatus

Figure 2C:
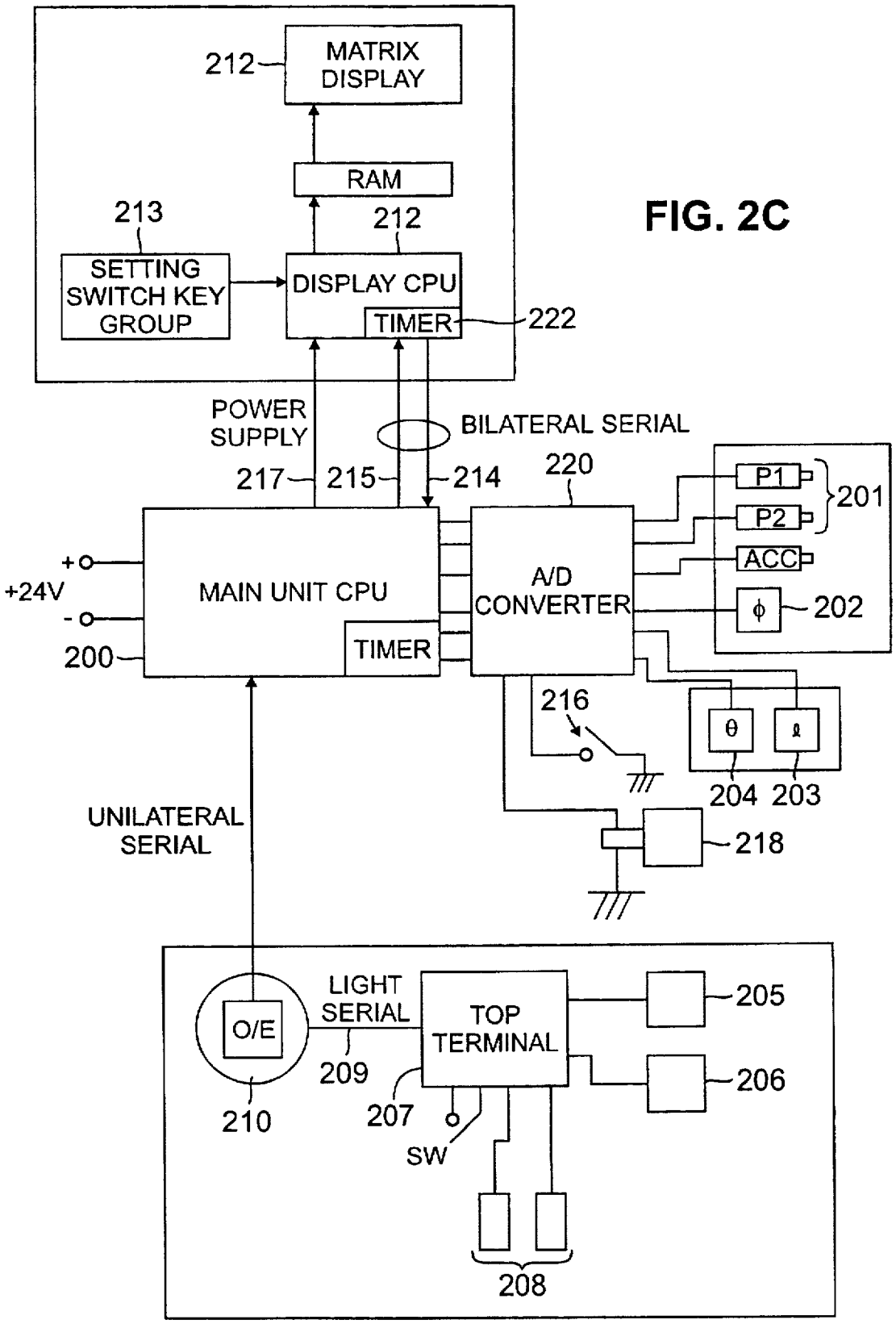
FIG. 2C is a block diagram showing a particular structure of the apparatus of this invention.

Referring to FIG. 2C, the main unit CPU 200 receives the actual load data from a stress sensor 201, and other crane operation parameter data from a slewing angle sensor 202, boom length sensor 203, boom angle sensor 204, boom top versus angle sensor 205, jib versus angle sensor 206, and stress sensor 208 respectively, disposed at various positions of the crane. Analog signals from sensors 201–204 are converted into digital signals through A/D converter 220 and the digital signals are input to the main unit CPU 200. The data from the sensors 205 and 206, which are disposed at the top of the boom, are sent to a top terminal 207 at the boom distal end, then sent to a cord reel 210 at the boom distal end via an optical fiber cable 209 where the data are subjected to photoelectric conversion at the cord reel, and then sent to the main unit CPU 200. The display unit CPU 211 is powered from the main unit CPU 200 via a line 217. Commands and data are transferred via bilateral serial lines 214 and 215 between the display unit CPU 211 and main unit CPU 200. The display 212 is a matrix type dynamic drive liquid crystal display (LCD). An LCD type display is preferable to other CRT, LED, or plasma displays and the like because the crane is generally used outdoors and the LCD display allows a clear display image even under strong sun light. During the night, LCD 212 is provided with back illumination. The setting key switch group 213 includes a plurality of touch keys corresponding in number to a plurality of items to be set. Signals for controlling the crane mechanism are outputted to a plunger 218, magnetic valve or the like. The main unit CPU 200 and display unit CPU 211 contain software timers 221 and 222, respectively, which can be set for use, for example, as an interrupt timer, an initial routine timer, a voice timer, an error check timer and the like.

Modes of Display Unit (1) Operation Status Setting Mode

Referring to FIG. 3, after the power is turned on, the display unit CPU automatically enters the operation status setting mode, and displays the image such as shown in FIG. 3. This mode is indicated at 301. Numerals 0, 1, 2 and 3 at 302 represent the boom status and they are flashing. When an operator sets desired numerals, they stop flashing and become steadily illuminated. First, in order to select a desired boom operation status, one of the ten keys on a touch panel 310A is depressed. Numeral 0 stands for the case of using only the main boom without using the jib and rooster, numeral 1 stands for the case of using the jib with one extension step, numeral 2 stands for the case of using the jib with two extension steps. After completion of the boom operation status setting, numerals will flash to indicate the rightside outrigger status 303. Numeral 3 represents a maximum projection, numeral 2 an intermediate projection, numeral 1 a small projection, numeral 0 a minimum projection, numeral 4 no outrigger mounting, and numeral 5 indicates running while lifting an object. Similar to the boom operation status setting, an operator selects a desired numeral upon activation of the ten keys on the touch panel 310A. Following the rightside outrigger setting, the leftside outrigger status 304 is set.

The display unit CPU next causes the set numeral to change its display status from flashing to continuous illumination, and sends the set boom and outrigger status data to the main unit CPU.

(2) Automatic Crane Safety Monitor Mode

Figure 4A:
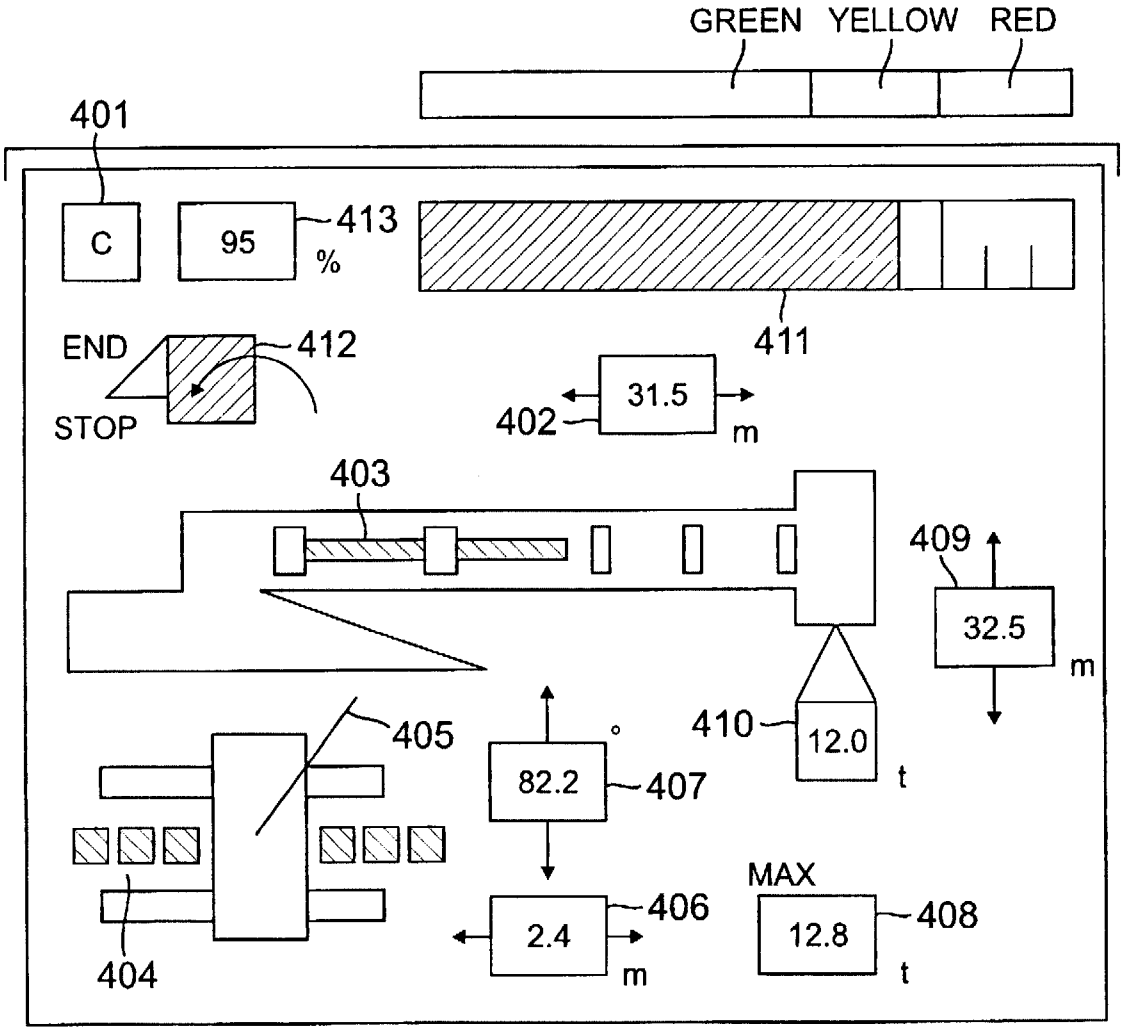
FIG. 4A shows a display pattern on the screen during an automatic safety monitor mode according to the apparatus of this invention.

After completion of the input operation for the operation status setting mode, the display unit CPU automatically enters an automatic crane safety monitor mode and displays an image such as shown in FIG. 4A. In accordance with the information supplied from the main unit CPU, the display unit CPU displays the current crane operation status, i.e., an outrigger setting 404, slewing position 405, operation radius 406, boom angle 407, lifting load 410, lifting distance 409, and boom length 402. The boom length is schematically displayed in the form of bar 403 whose length changes in correspondence with the actual length of the boom.

The safety limit of the current crane operation status is indicated at 411 in the form of a bar graph. The numerical representation of the safety limit is indicated at 413. The limit (maximum) load at the current crane operation status is indicated at 408. When the crane operation status nears the limit zone (when the bar graph 411 extends to the yellow zone), a warning is issued. When the status reaches the limit, the crane is automatically stopped. The main unit CPU monitors the actual crane operation status by using the data from various sensors, accesses the memory to obtain the maximum limit load for that operation status, and checks if the accessed maximum limit load is equal to or smaller than the actual load. If the actual load equals the maximum limit load for the current crane operation status, the main unit CPU delivers a signal for locking the crane operation mechanism. During the automatic crane safety monitor mode display, the display unit CPU visually provides to an operator a crane operation status. The crane operation status reaches a limit value when a crane boom has entered into a working limit zone, or when it has an operation range limit set by an operator (described later with reference to FIG. 5). In the latter case, a warning is issued and the crane is automatically stopped.

One of the distinctive features of this embodiment is to display an automatic stop cause 412. If the crane stops automatically during the automatic crane safety monitor display mode, it is difficult for an operator to find out at once the cause of the automatic stop. It is difficult to ascertain the cause of the automatic stop especially for the case of crane turnover or failure caused by overload during operation, and for the case of crane operation during the automatic crane safety monitor mode while setting the crane operation range or zone (described later with FIG. 5). Further, if the wire continues to be released over a range exceeding its length, then a reverse winding of the wire occurs during the crane operation. In such a case, an automatic stop is also effected. In the automatic crane safety monitor mode of this embodiment, the cause of automatic stop is illustratively displayed at 412 on the screen.

Figure 4B:
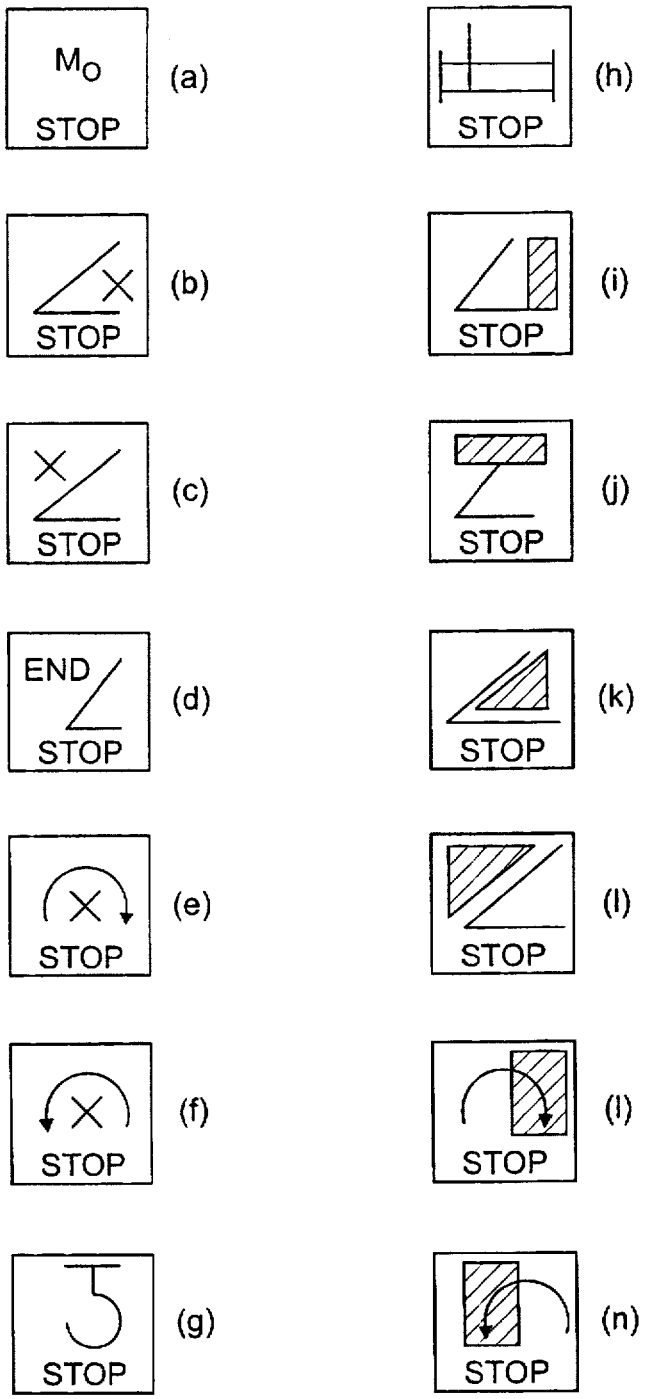
FIG. 4B shows illustrative representations of the causes of automatic stop to be displayed on the screen according to the apparatus of this invention.

The illustrative representations of various types of causes of automatic stop are shown in FIG. 4B (a) to (n).

If a plurality of automatic stop causes occur during automatic crane safety monitor mode, each of those causes will be displayed on the screen. The representations (a) to (n) in FIG. 4B have the following meanings:

(a) automatic stop due to the crane reaching its limit load moment;

(b) automatic stop because the boom is at its lower angle limit;

(c) automatic stop because the boom is at its higher angle limit;

(d) automatic stop because the boom has reached the derrick end;

(e) automatic stop because the boom reached its right slewing limit;

(f) automatic stop because the boom reached its left slewing limit;

(g) automatic stop because the boom reached its overhoist position;

(h) automatic stop because the crane released the entire length of the lifting wire rope;

(i) automatic stop because the boom reached its radius limit;

(j) automatic stop because the boom reached its lifting distance limit;

(k) automatic stop because the boom reached its low angle limitation;

(l) automatic stop because the boom reached its high angle limitation;

(m) automatic stop because the boom reached its right slewing limitation;

(n) automatic stop because the boom reached its left slewing limitation.

The automatic stop causes described above and shown in FIG. 4B are displayed when the specified conditions have been met. The automatic stop cause display permits an operator to visually recognize why an automatic stop occurred which facilitates crane operation.

(3) Operation Range Limit Mode

Figure 5:
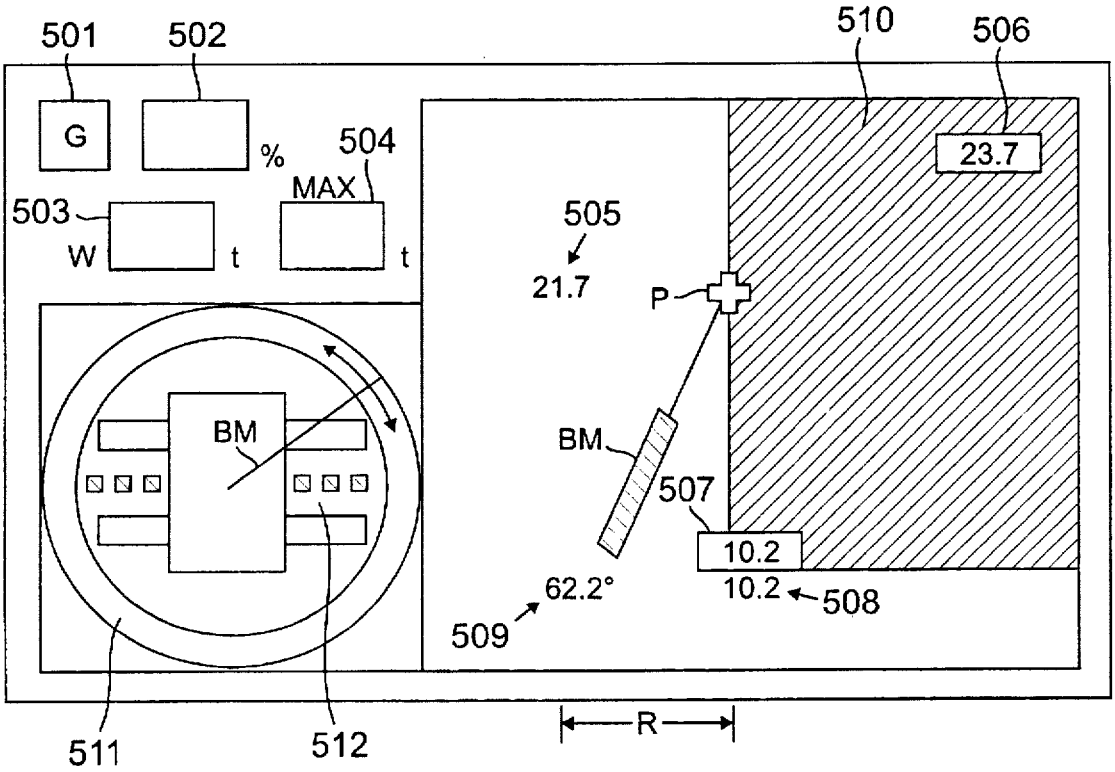
FIG. 5 shows a display pattern on the screen during an operation range setting mode according to the apparatus of this invention.
Figure 5:
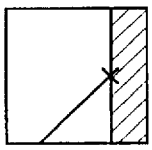
Figure 5:
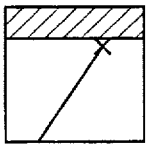
Figure 5:
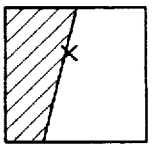
Figure 5:
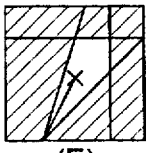
Figure 5:
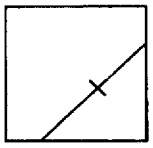
Figure 5:
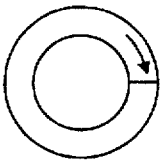
Figure 5:
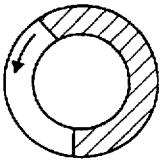

In addition to setting the crane operation range for the crane turnover and failure limit, the boom movable range is also set so as to prevent boom contact with nearby buildings and the like. It is desirous if a warning is issued or the crane is automatically stopped if the boom is moved in the direction departing from the set movable range. In response to a depression of key A on the touch panel 310B of FIG. 3, the display unit CPU enters the operation range limit display mode and displays a screen image such as shown in FIG. 5. The operation range limit display mode is indicated at 501. The safety degree numerical display value is indicated at 502. At the right side of the screen, the boom is schematically shown at BM, and its distal end represented by a cross is indicated at P. The schematically displayed boom BM follows the actual boom motion, and is controlled by the display unit CPU in accordance with the operation parameters supplied from the main unit CPU. In setting the boom operation radius limit an operator moves the boom to the limit point (the schematically displayed boom BM also moves to the limit point). Upon depression of key B on the touch panel 310B, the non-operation range is set at the hatched area at the right of the boom distal end P. The operation radius R is displayed as the operation radius limit value at 507 within a rectangular frame. In addition to the radius limit (A), higher limit of angle (B), and lower limit of angle (C), a lifting distance limit (D) may also be set. The characteristic point of this setting is that the boom is actually moved to the limit point and a key is depressed to set the non-operation range instead of calculating and setting the numerical limit value without moving the boom to the limit point. This method of setting is advantageous because the operation range can be determined by moving the actual boom at the field location. The total operation limit range covering all the limits (A) to (D), such as the radius limit and the like, is shown as (E). The boom is allowed to move within the area that is not hatched. Other numerical values representative of the actual boom are also displayed on the screen including boom angle 509, actual radius 508, boom length 506, and lifting distance 505.

At the left of the screen, a boom slewing angle range limit is displayed. A boom BM schematically displayed within an area 511 follows the actual boom motion. The boom is moved to a boom slewing angle limit point and the boom slewing angle range limit is set upon activation of a setting key on the touch panel. At the slewing angle range limit, one side of the boom may be set as indicated by (F) or both sides thereof may be set as indicated by (G). The outrigger setting status 512 previously set is also displayed as index marks on the boom slewing display area.

For reference purposes, a lifting load 503 and maximum load 504 are also displayed on the screen.

The contents set during the operation range limit display mode are transferred in the form of numerical data from the display unit CPU to the main unit CPU. Assuming that the radius limit setting key is depressed under the conditions of the boom length li and the boom angle $\theta_i$, the limit radius numerical data obtained is $R_L$=li sin $\theta_i$. The display unit CPU displays the hatched area 510 on the right side of R. If the boom moves toward the outside of the set operation limit range, the main unit CPU detects it so that a warning is issued or the crane is automatically stopped. An operator can visually recognize the motion of the boom within the allowable operation range as shown at (E) with respect to the non-operation range. It is a significant advantage that an operator can forecast the next stage of boom motion.

(4) Target Display Mode

Figure 6:
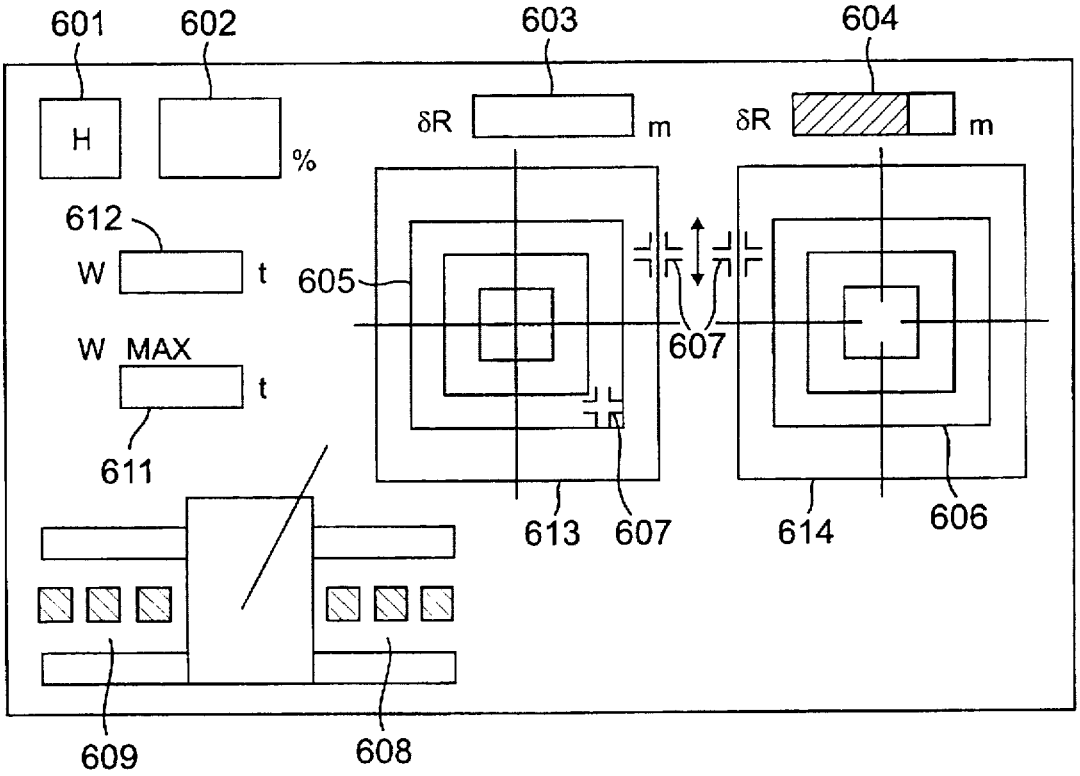
FIG. 6 shows a display pattern on the screen during a target mode according to the apparatus of this invention.

Upon activation of a mode selection key on the touch panel 310B, the display unit CPU enters the target display mode which displays a screen image such as shown in FIG. 6. This target display mode is used when an operator cannot see a lifting load from the operator seat of the crane. Target index marks 605 and 606 indicated by solid lines in FIG. 6 are used for the setting of target points. The side of an innermost square of the target index mark corresponds to an actual length of 15 cm, that of the next square to an actual length of 30 cm, and that of the outermost square to an actual length of 60 cm. First, the crane is operated to move an actual lifting load to a target location which is set as a first target upon activation of a key on the touch panel 310B. The first target is taken to be at the origin on the coordinate system of the screen. A lifting load position 607 is displayed on the screen at a position apart from the origin by a certain distance. After setting the first target, an operator can recognize from the screen the positional relationship of the lifting load to the target position without seeing the actual lifting load. It is common for a crane operation to slew the crane and transfer a lifting load from a first point to a second point. In such a case, the target index mark 605 is set at the first point, and the target index mark 606 is set at the second point. The index marks 605 and 606 have independent coordinate systems so that the distance between the target index marks 605 and 606 is not related to an actual distance therebetween. The frames indicated by a dotted line are the effective display area of the coordinate systems of the first and second points, the side of the frame corresponding to an actual length of, e.g., 100 cm. The position of a lifting load within this effective area is represented by the ✢ mark 607. Even if the lifting load moves outside of this area, the ✢ mark as at 607' is displayed while moving along the dotted line so that the direction of the lifting load can be recognized by an operator. While seeing the ✢ mark on the screen relative to the target index mark, an operator can continue the transfer operation of the lifting load between the first and second points without actually seeing them.

The numerical values of the distances of the lifting load to the first and second points are displayed at the upper area of the screen at 603 and 604. For convenience purposes, the outrigger setting 609 and slewed boom position 608 are displayed at the lower left area of the screen. For reference purposes, also displayed are a lifting load 612 and a maximum load 611. Reference numeral 601 indicates the display mode, and 602 indicates the safety numerical value for the crane operation during this display mode.

Lifting load data which represents the actual position of a lifting load is calculated at the main unit CPU by using the data from various sensors and the data of the operated crane structure and is supplied to the display unit CPU. Upon activation of a touch key on the display unit to set a certain position as the origin of the target index mark 605, the display unit CPU uses the lifting load position data at that time as the origin of the index mark 605. The display unit CPU displays the lifting load position 607 on the screen relative to the target index mark in accordance with a difference between the current lifting load position data and the lifting load position data at the time of setting. If the lifting load moves outside of the outermost square of the index mark, the display unit CPU displays the ✢ mark along the dotted line 613 to indicate the direction of the lifting load position. If the lifting load comes thereafter near the first or second point (i.e., comes within the outermost square of the index mark), then the position is again displayed.

An example of the display image shown in FIG. 6 provides two independent two-dimensional target index marks. It is also possible to display three or more index marks, or three-dimensional index marks.

(5) Limit Load-Slewing Angle Display Mode

Figure 7:
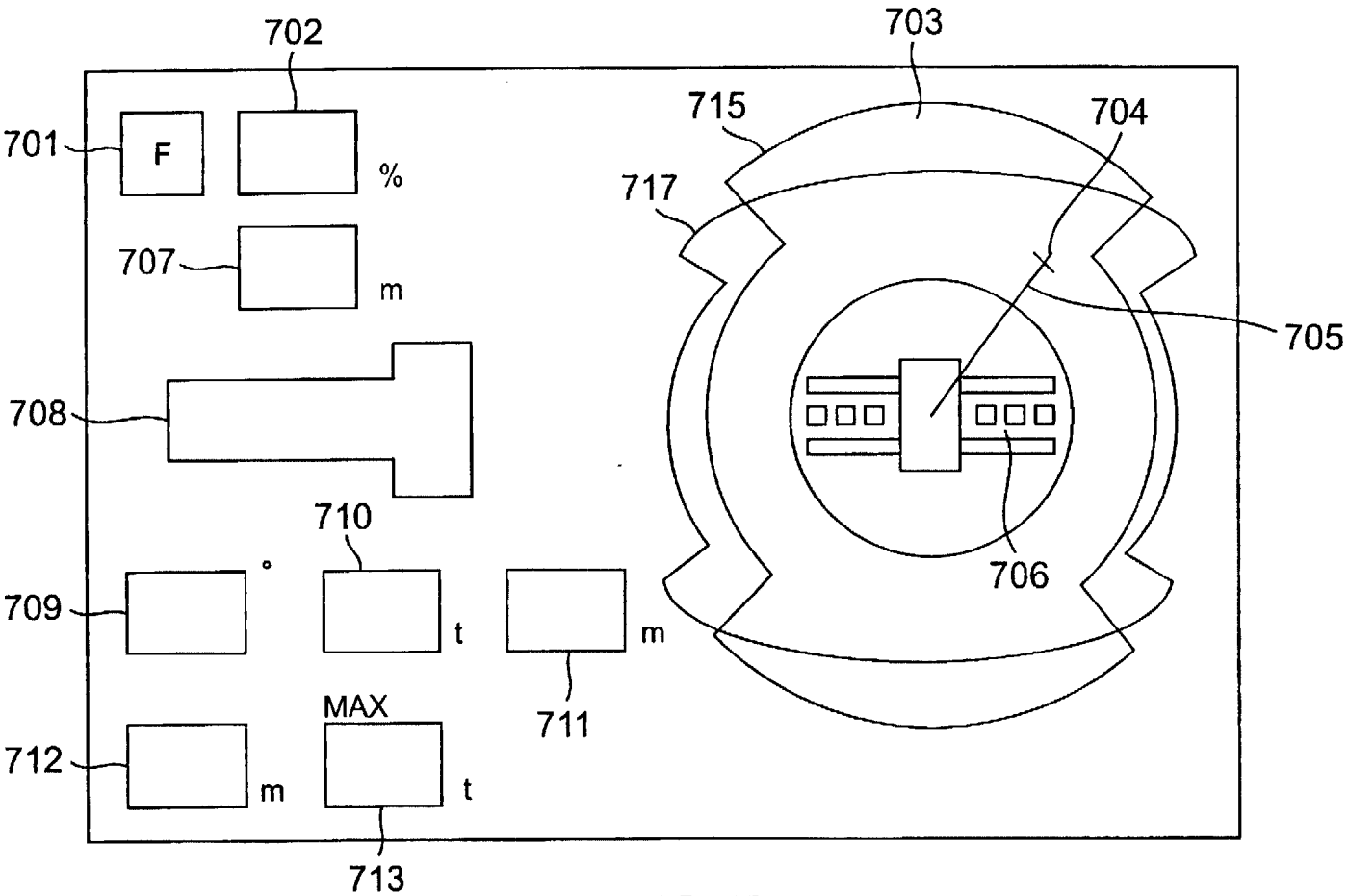
FIG. 7 shows a display pattern on the screen during a limit load-slewing angle mode according to the apparatus of this invention.

The lifting load capacity of a crane depends on the posture of the crane structure such as its front, rear, right and left position, so paying attention to the boom slewing of the crane is important. When the display unit CPU enters the limit load-slewing angle display mode upon key activation on the touch panel 310B, the display image as shown in FIG. 7 appears on the screen. A crane is schematically shown at the center on the screen, with the outrigger setting 706 being displayed. 8A boom is schematically displayed at 705 for indicating the boom slewed position. A cross mark 704 at the distal end of the schematically displayed boom 705 indicates the current distal end of the boom. A solid line 715 or dotted line 717 indicates a safety load range area 703. The operation is judged as safe so long as the cross mark 704 is displayed within the safety load range area. The safety load range area shown on the screen changes with the set outrigger conditions. It is convenient for a crane operator to use this mode when the crane is slewed.

For reference purposes, there are also displayed on the screen, a mode indication 701, safety numerical value 702, boom length numerical value 707, boom operation status 708, boom angle 709, actual load 710, lifting distance 711, operation radius 712, and maximum load 713.

(6) Performance Curve Display Mode

Figure 8:
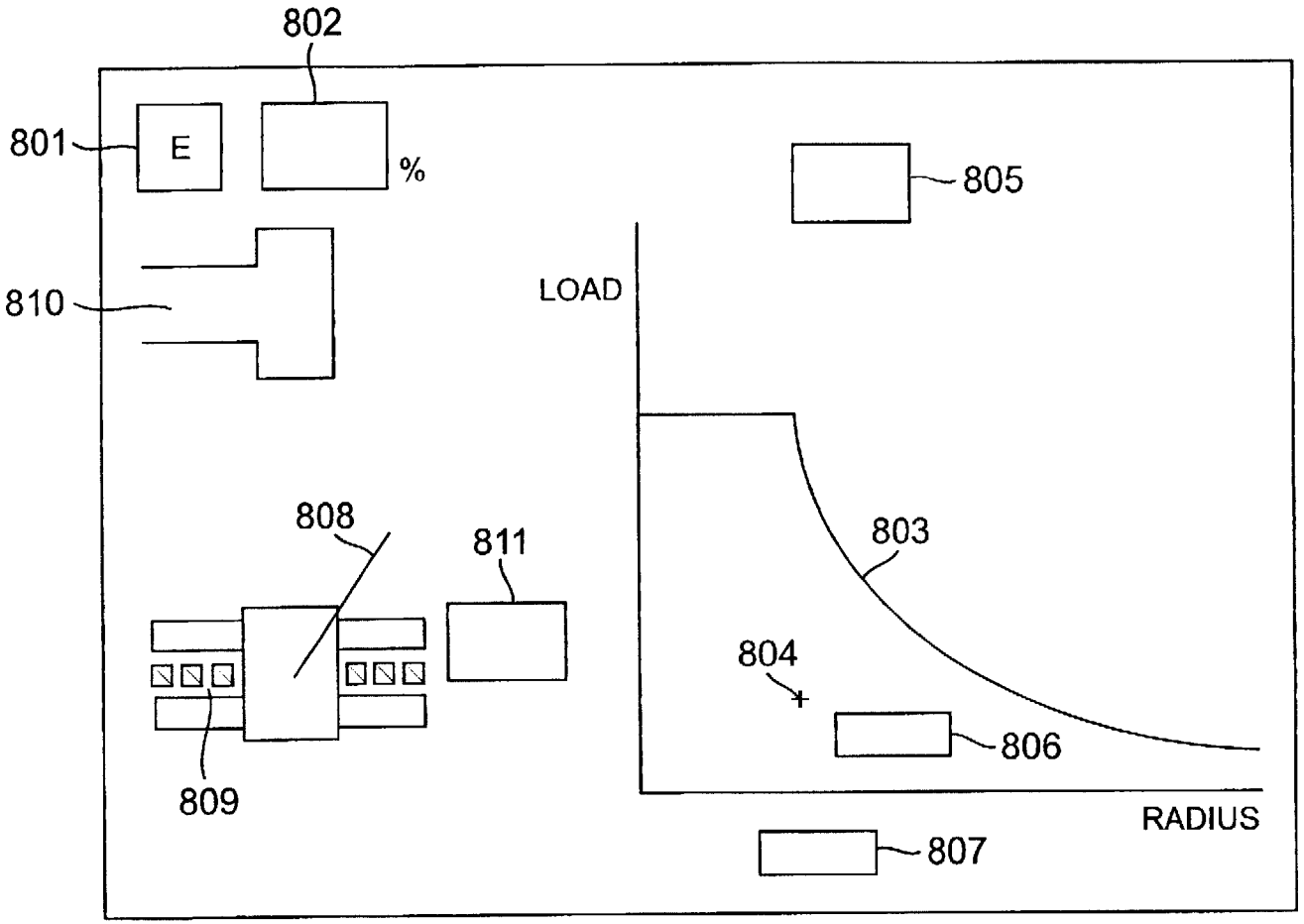
FIG. 8 shows a display pattern on the screen during a performance curve display mode according to the apparatus of this invention.

A typical parameter for safe crane operation is a graph of the lifting load curve relative to the operation radius as shown in FIG. 2B. It is convenient for an operator to know the operation safety margin by visually recognizing the current operation status from this safety index curve. Upon activation of a mode switching key on the touch panel 310B, the display unit CPU enters the performance curve display mode and displays a display image on the screen as shown in FIG. 8. The performance curve is collectively determined from a combination of crane operation parameters such as the outrigger projection state, boom length, use or non-use of jib, slewing angle and the like. The main unit CPU uses such operation parameters, accesses the previously stored specific load data relative to the operation radius conforming with each crane specification, and sends the specific load data to the display unit CPU. The display unit CPU displays an operation status performance curve 803 such as shown at the rightside on the screen. A + mark at 804 is displayed at the coordinate position determined by the current operation radius and actual load. An operator can know the operation margin from the position of the + mark relative to the curve. The numerical value of a marginal operation radius is displayed at 806 near the + mark. This numerical value indication 806 moves as the + mark 804 moves so that the operator can easily recognize this value.

For reference purposes, during the performance curve display mode, there are displayed a display mode 801, safety degree 802, current specific load 805, current operation radius 807, current actual load 811, boom slewing status 808, outrigger setting 809, and boom operation status 810.

(7) Performance Display Mode

Figure 9A:
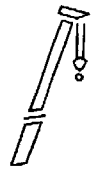
FIG. 9A shows a part of the crane total specific load table.
Figure 9B:
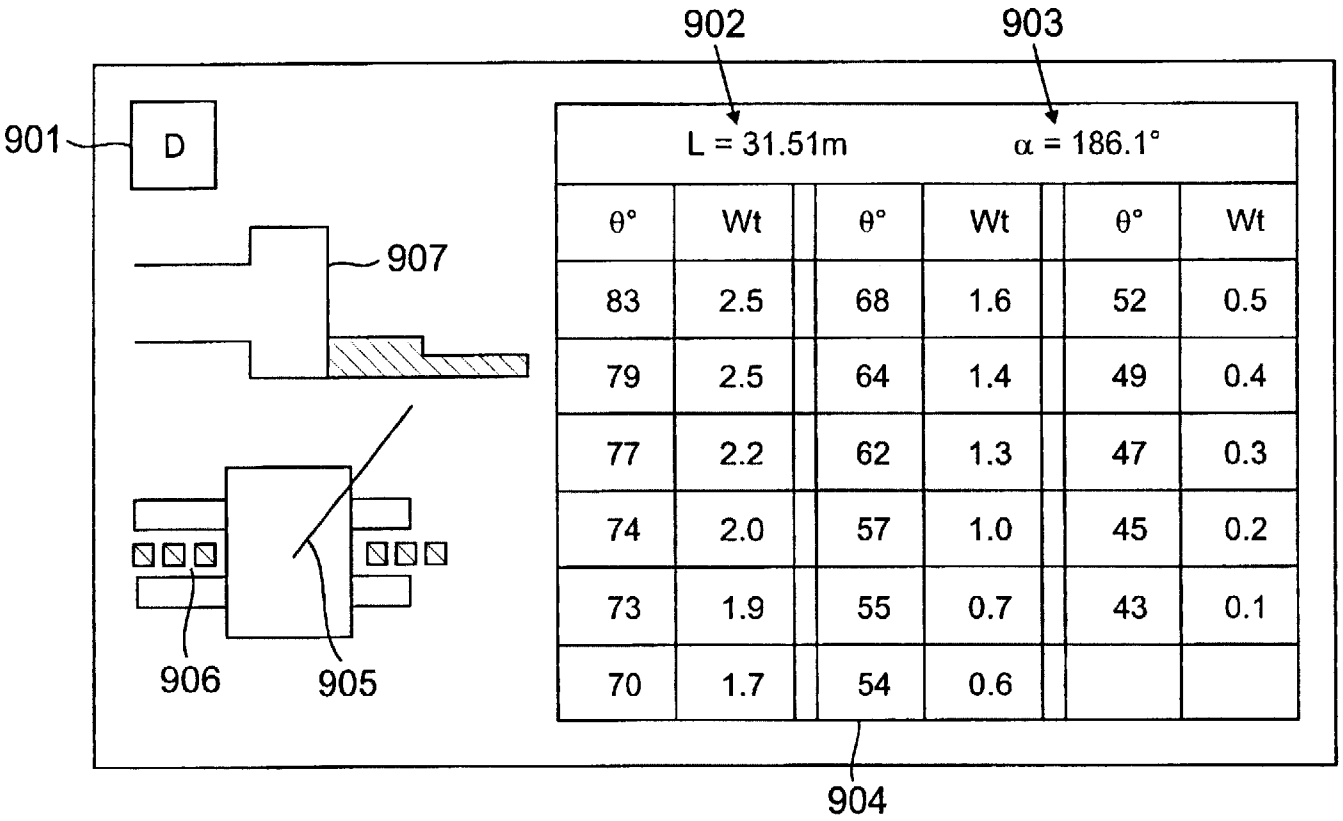
FIG. 9B shows a display pattern on the screen during a performance table display mode according to the apparatus of this invention.

There is provided a total specific load table such as shown in FIG. 9A which is referred to for the crane safety operation. This table provides specific loads relative to operation radii conforming with each crane specification, when the outrigger setting status and boom length are given. While referring to the table, an operator can judge if, for example, the set outrigger and boom length are sufficient for the lifting load and operation radius of an operation to be carried out. Upon key activation on the touch panel 310B, the display unit CPU displays a display image as shown in FIG. 9B. This mode is referred to for an operation to be carried out so that in this mode the crane is essentially in a stop state. An operator first uses the ten keys 310A to enter the numerical value of a desired boom length in an area 902 where a cursor flashes. During this mode, the entered boom length is not set as an actual boom length value. Thereafter, the flashing cursor moves to an area 903 wherein the numerical value of a desired slewing angle is entered. The outrigger status and the like have already been set during the previous operation status display mode (FIG. 3). Upon input of these values, the display unit CPU receives from the main unit CPU (or the display unit CPU itself may have such data) maximum specific load data Wt for the operation boom angle for the given conditions, and displays them in a numerical value table 904. If the boom length and the like set for a desired operation are determined as improper upon reference to the displayed data, the table with these numerical values is reset, and a new boom length and the like are again entered.

For reference sake, during this mode there are displayed on the screen a mode indication 901, boom operation status 907, outrigger setting 906, and slewing angle 905.

Operation Sequence of Apparatus

According to the structure of the apparatus of this embodiment, the main unit and display unit each have their own CPU which executes an operation sequence running on a different program. The main unit CPU receives the operation parameters from sensors and the operation range setting data from the display unit CPU, calculates the actual load, operation radius, limit load and the like for the automatic stop control of the crane mechanism, and sends the calculated data to the display unit. The display unit CPU displays the display image for a selected mode in accordance with the data from the main unit CPU, modifies the displayed image in accordance with an input from a setting key, and sends the input setting data to the main unit CPU. The main unit and display unit CPU's carry out sequences running independently, so the transfer of commands and data therebetween is executed upon an interrupt.

A program for sequential control of each unit CPU is stored in ROM. The display unit has a video RAM. Display graphics data for a selected display mode are written in the RAM the contents of which are modified as the crane operation status changes. The graphics data stored in the video RAM are transferred to the display screen to refresh the display image, e.g., at an interval of 150 ms.

Transmission/reception of data $D_A$ and $D_B$ by the main unit relative to the display unit is effected by means of step synchronization (start/stop asynchronous) data communication. Each time the main unit configures data to be transmitted to the display unit, a transmission request interrupt is generated and the main unit CPU executes the data transmission. The display unit generates a reception request interrupt to receive the transmitted data. Transmission/reception of data by the display unit relative to the main unit is performed in a similar manner.

The data representative of the crane operation status from various sensors are received by the main unit CPU from A/D converter 220 (see FIG. 2C). The main unit CPU receives the sensor data upon reception of a sensor data read request interrupt at a predetermined time interval corresponding to the operation timing of the A/D converter 220.

The display unit checks the key input status at a predetermined time interval, and when a key is depressed the key input data are processed.

A timer interrupt for executing a process at a predetermined time interval is supplied to the main and display unit CPUs to execute the corresponding process.

The display unit CPU writes the graphics data in the video RAM in accordance with the data given thereto, displays a display image on the screen, and supplies the operation limit setting data and the like to the main unit.

In accordance with the data given to the main unit, the main unit CPU calculates the boom radius, lifting distance, actual load and limit load, compares them with the performance data determined in accordance with each crane specification, and outputs a control signal to be used, e.g., for automatically stopping the crane.

(1) Main Unit Operation Sequence

Figure 10:
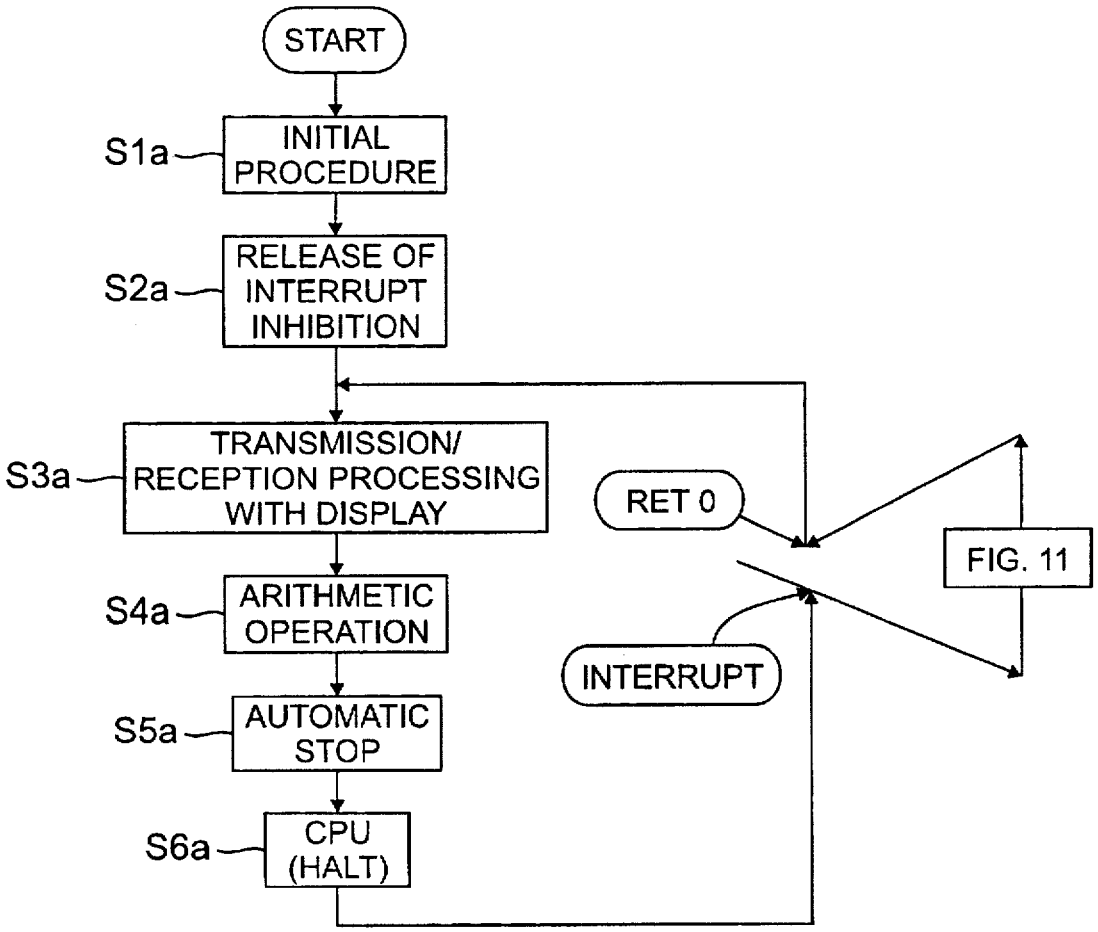
FIG. 10 is a main flow chart showing the operation sequence of the main unit.

In response to power-on of the apparatus or activation of a reset key, the main unit executes the main flow sequence from S1*a* to S6*a* shown in FIG. 10.

At the first step S1*a*, the apparatus is checked to see if it is in a proper state, and the initial procedure is executed to set the main unit CPU for ensuring the correct operation of the following sequence. Prior to this initial procedure, an interrupt is inhibited, and after the initial procedure, the interrupt inhibition is released at step S2*a*.

At the next step S3*a*, it is checked if there are data to be transmitted to the display unit, and data to be received from the display. If there are data, the transmission/reception of the data is effected. The transmitted data are received by the main unit in accordance with a hard interrupt routine in the similar manner to receiving data from sensors.

The received and processed data are subjected to various arithmetic operations at step S4*a*. Specifically, there are obtained crane operation parameters such as an actual load, boom radius, lifting distance and the like in accordance with the boom length, boom angle, stress and the like, and a limit load in accordance with the parameters and limit load data previously stored in accordance with a crane specification.

Using the arithmetic operation results at step S4*a*, the safety degree of the crane operation is calculated, the set operation limit value is compared with the crane operation status, and an automatic stop process is executed at step S5*a* if the crane operation is in danger or at an operation limit.

After the above sequence steps, the main unit CPU enters a HALT state at step S6*a*. The main unit CPU receives a hard interrupt by an external interrupt request (IREQ) such as data fetch, and executes an interrupt processing (the contents of FIG. 11). After the interrupt processing, the flow returns to the loop start point. If there is no hard interrupt, the main unit CPU remains at step S6*a*. Although the hard interruption is shown in FIG. 10 as present between step S6*a* and the loop start point, it may be provided at any step from step S3*a* to S6*a*.

In the main flow, data reception by the main unit and data transmission to the display unit are effected upon reception of an interrupt. When new data are received or transmitted once, there are executed a series of operations including data transmission/reception with the display unit, data arithmetic operation, and automatic stop process.

An interrupt routine (FIG. 11) starts upon reception of a hard interrupt. The interrupt routine started by a hard interrupt includes data reception/transmission, and soft interrupt routines 1 S0*c* and 2 S8*c* (FIG. 12). Each time a hard interrupt is received, data reception/transmission is carried out. If the amount of data becomes one block size after a predetermined number of hard interrupt data receptions/transmissions, a soft interrupt 1 start (activation) flag is set. As the soft interrupt 1 start flag is set, the soft interrupt 1 processing of the interrupt routine is executed and a soft interrupt 2 start flag is set. As the soft interrupt 2 start flag is set, the soft interrupt 2 processing is executed.

The hard interrupt and soft interrupts 1 and 2 therefore have a hierarchic structure. Data reception which is processed in a short time is performed by a hard interruption, and during this processing another hard interrupt is inhibited. Processing which requires a longer time is performed by the soft interrupt 1, and processing which requires a further longer time is performed by the soft interrupt 2. A hard interrupt is allowed while executing a soft interrupt so that the interrupt inhibition time is shortened, resulting in high speed data input/output processing.

Figure 11:
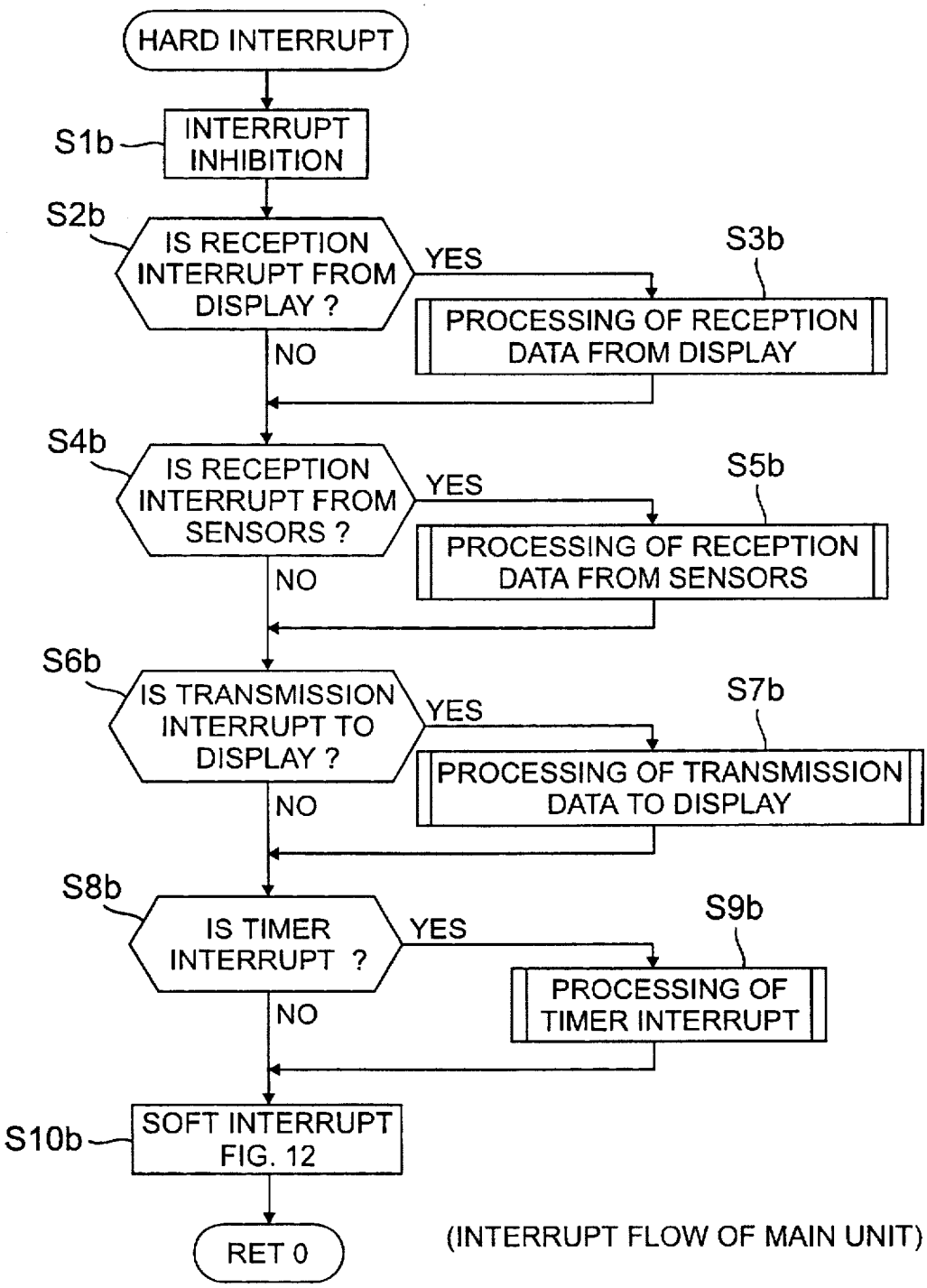
FIG. 11 is a flow chart showing a hard interrupt from the main unit.
Figure 12:
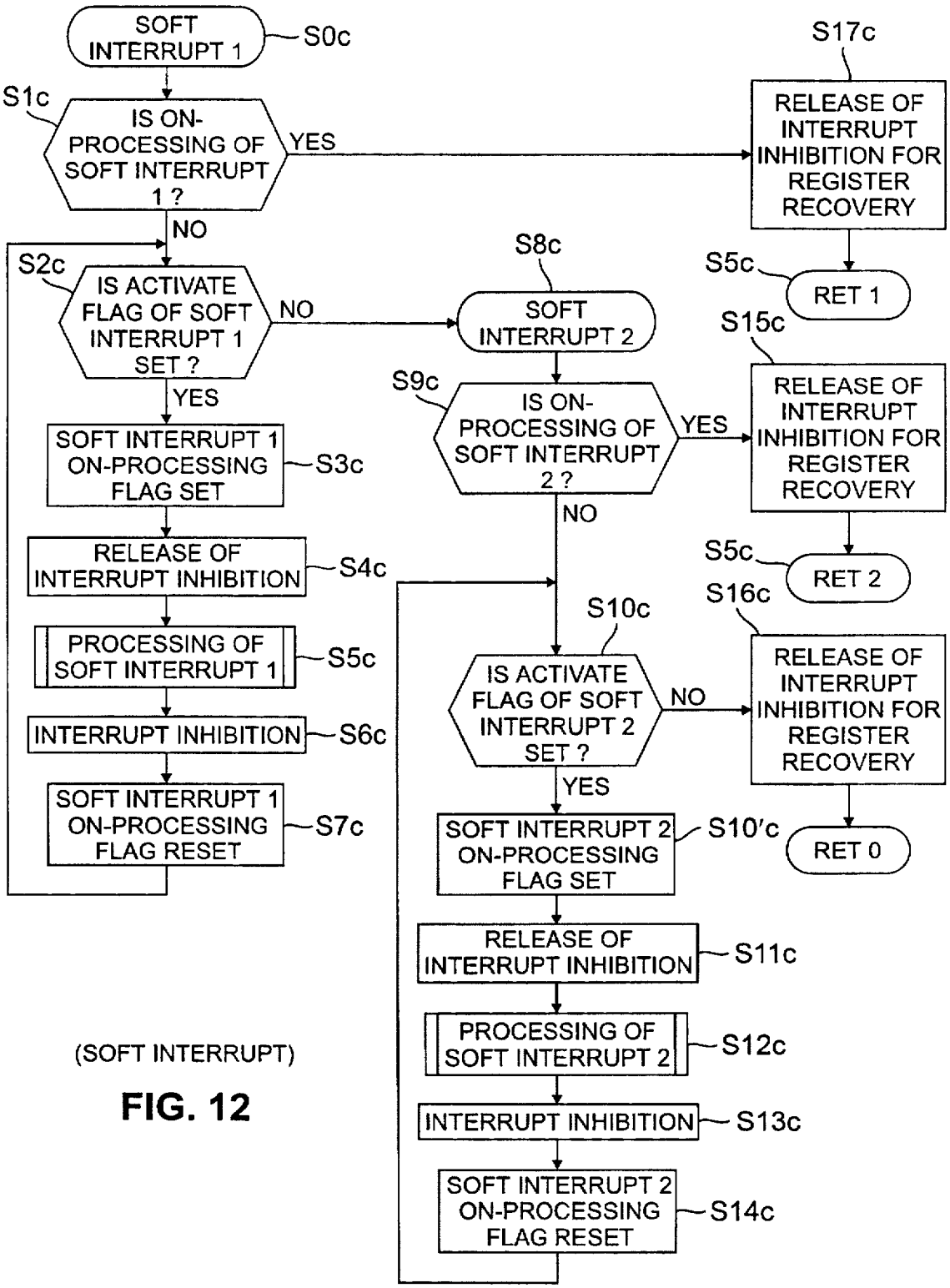
FIG. 12 is a flow chart showing a soft interrupt from the main and display units.

Referring to FIG. 11, upon reception of a hard interrupt by the main flow shown in FIG. 10, another interrupt is inhibited at step S1*b*. The type of interrupt is checked at steps S2*b* to S9*b* if it is an interrupt of reception/transmission from/to the display unit, an interrupt of reception from sensors, or a timer interrupt. In accordance with the discriminated type, the corresponding hard interrupt processing is executed. Specifically, the data received from the display unit are stored in a temporary storage area, the data to be transmitted to the display unit are transferred from the temporary storage area to the transmitter and transmitted to the display unit, or the data received from sensors are stored in the temporary storage area. If the total data reception/transmission amount becomes one block after a certain number of hard interrupts, the soft interrupt 1 start flag is set.

Upon completion of the soft interrupt processing, the soft interrupt 1 sequence S3*b* starts (FIG. 12). After this soft interrupt 1 sequence, it returns to the main flow shown in FIG. 10 (RET0).

Referring to FIG. 12, at the soft interrupt 1 sequence, the soft interrupt 1 on-processing flag is checked (step S1*c*). If the flag is not set and the processing is not executed, then it is checked if the soft interrupt 1 start flag is set (step S2*c*). If the flag is not set because the data amount to be processed is insufficient, the flow advances to step S8*c*. If the soft interrupt 2 is not processed and the soft interrupt 2 start flag is not set, the flow advances via steps S9*c* and S10*c* to step S16*c*. At this step S16*c*, the contents of the status setting register are recovered and the interrupt inhibition set at step S1*b* shown in FIG. 11 is released, to thereafter return to the main flow shown in FIG. 10 (RET0).

The above case illustrates that when a hard interrupt occurs at the main flow, the data are received at step S3*b* shown in FIG. 11, and the flow returns to the main flow.

If the soft interrupt start flag is set at step S2*c* shown in FIG. 12, the soft interrupt 1 on-processing flag is set (step S3*c*). Since a hard interrupt is allowed during the soft interrupt 1 processing, the interrupt inhibition set at step S1*b* shown in FIG. 11 is released (step S4*c*), and thereafter the soft interrupt 1 processing is executed (step S5*c*). During the soft interrupt 1 processing, the soft interrupt 1 start flag is reset and if the conditions are met the soft interrupt 2 start flag is set. After executing the soft interrupt 1 processing, the hard interrupt inhibition is again effected (step S6*c*) and the soft interrupt 1 on-processing flag is reset (step S7*c*), to return to the loop start point at step S2*c*. At this time, the soft interrupt 1 start flag is being reset, the flow advances from step S2*c* to step S8*c* for the soft interrupt 2 processing. At step S8*c*, if the soft interrupt 2 processing is not executed and the soft interrupt 2 start flag is not set, then the flow advances via steps S9*c* and S10*c* to step S16*c* whereat the contents of the status setting register at the start of the interrupt are recovered and the interrupt inhibition set at step S5*c* is released, to return to the main flow shown in FIG. 10 (RET0).

The above case illustrates that data are received upon occurrence of a hard interrupt, the data amount becomes one block, the soft interrupt 1 start flag is set, the soft interrupt 1 processing for the one data block is executed, and the flow returns to the main flow.

Since a hard interrupt is allowed during the soft interrupt 1 processing of the soft interrupt sequence, it can be accepted during the soft interrupt 1 processing at step S5*c*. When a hard interrupt occurs during the soft interrupt 1 processing at step S5*c*, the hard interrupt routine is effected so that the data are received at steps S1*b* to S3*b* shown in FIG. 11. Thereafter, the flow advances to step S1*c* and to step S17*c* shown in FIG. 12 to recover the contents of the register and release the interrupt inhibition, and returns (RET1) to the intercepted point at step S5*c* to thereby resume the soft interrupt 1 processing. In the above manner, data can be received by a hard interrupt even during the soft interrupt 1 processing.

It is assumed that the soft interrupt 2 start flag is set during the soft interrupt 1 processing. In this case, after the soft interrupt 1 processing is completed and the soft interrupt 1 start flag is reset, the flow advances from step S2*c* to step S8*c* for the soft interrupt 2 processing sequence. If the soft interrupt 2 processing is not being executed, the flow advances from step S9*c* to S10*c*, and to steps S10'*c*, S11*c*, S12*c*, S13*c* and S14*c* for executing the soft interrupt 2 processing and returning to the loop start point. At this time, since the soft interrupt 2 start flag is being reset, the flow returns via step S16*c* to the main flow (RET0) to terminate a series of interrupts.

A hard interrupt is also allowed during the soft interrupt 2 processing as during the soft interrupt 1 processing. If a hard interrupt occurs during the soft interrupt 2 processing, data are received at the flow shown in FIG. 11, and the flow advances via steps S1*c*, S2*c*, S8*c* and S9*c* to step S15*c* whereat the contents of the register are recovered and the interrupt inhibition is released to return (RET2) to the intercepted point of the soft interrupt 2 processing at step S12*c*.

(2) Display Unit Operation Sequence

Figure 13:
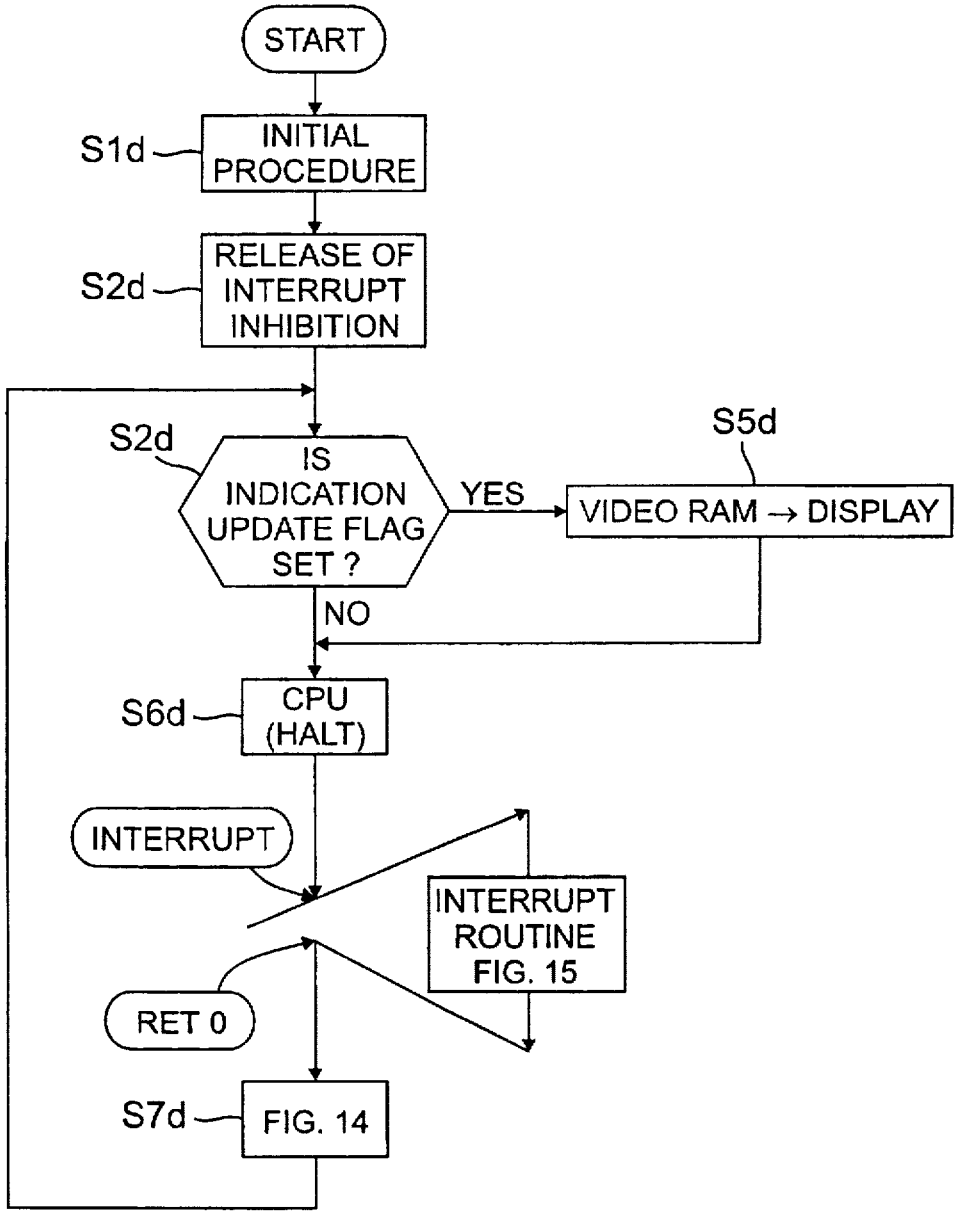
FIG. 13 is a main flow chart showing the operation sequence of the display unit.

The main flow for the display unit is shown in FIG. 13. After performing an initial procedure at step S1*d* in order to ensure a proper execution of the following sequence, an interrupt inhibition is released at step S2*d*.

To display the crane operation status which changes from time to time on the screen, the graphics image data for a selected display mode are written in the video RAM. The graphics image data are read from the video RAM at a predetermined time interval, e.g., of 150 ms to drive the display and refresh the display image on the screen. In this embodiment, the graphics image data are stored in the video RAM as the numerical values of coordinate points at both ends of each line segment constituting the display image. If a display refresh flag or indication update flag is being set at step S3*d*, the data in the video RAM are sent to the display to refresh the display image at step S5*d*.

After the power-on or resetting, the initial display data stored in the video RAM at the initial procedure are displayed. The display unit CPU then enters a HALT state and does not execute the next instruction until a hard interrupt is received.

A hard interrupt to the display unit CPU is generated by a timer interrupt and a data transmission/reception request with respect to the main unit CPU. The setting information or transmission/reception data are received or transmitted according to the type of interrupt (FIG. 15).

After the interrupt processing, the flow returns to the main flow and executes the processing corresponding to a selected mode. The mode processing are always activated by a hard interrupt which is also allowed during the mode processing. A hard interrupt is inhibited only when a hard interrupt processing which requires a short time is being executed.

Figure 14:
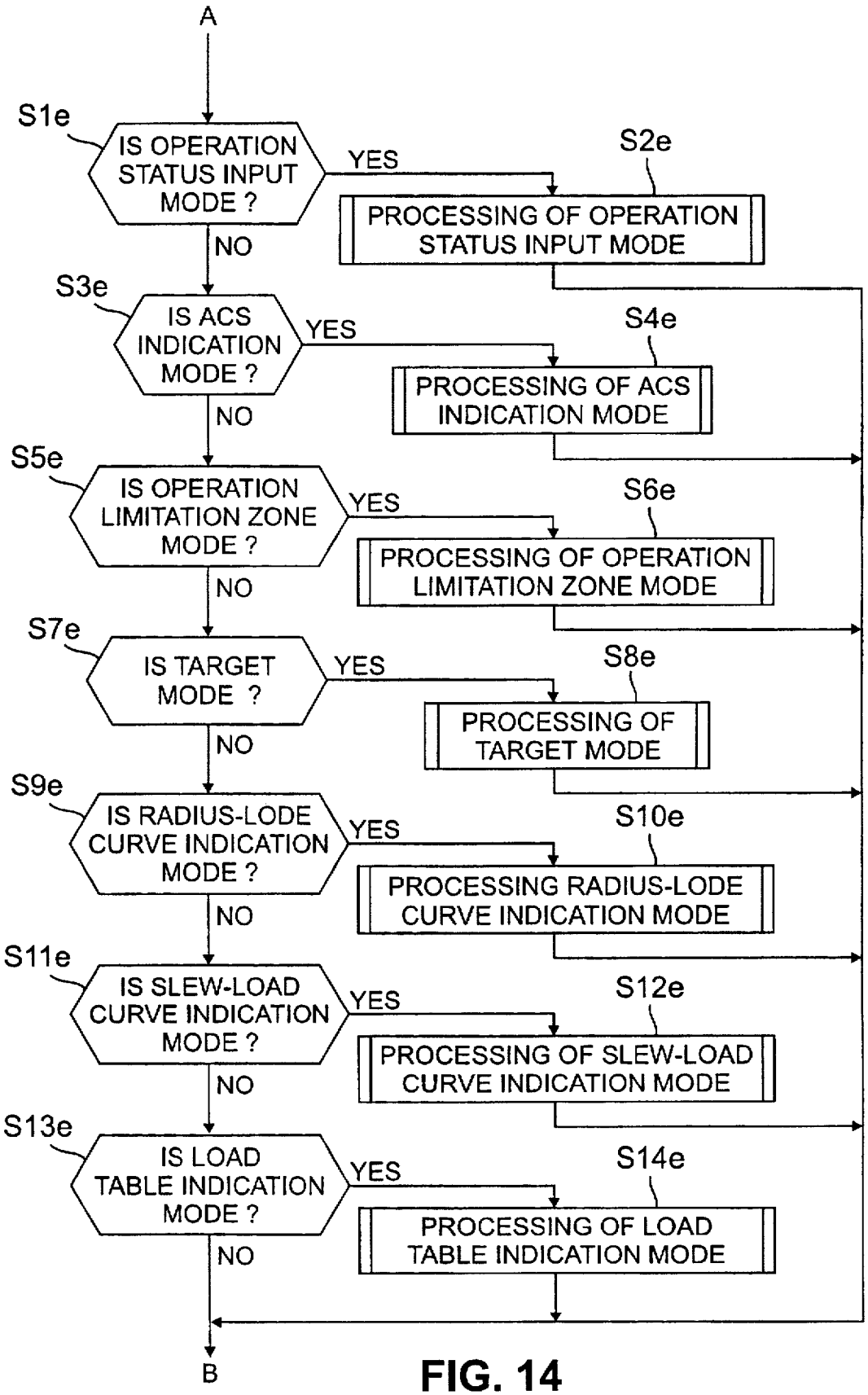
FIG. 14 is a flow chart showing the processing of respective display modes in the main flow chart for the display unit.
Figure 15:
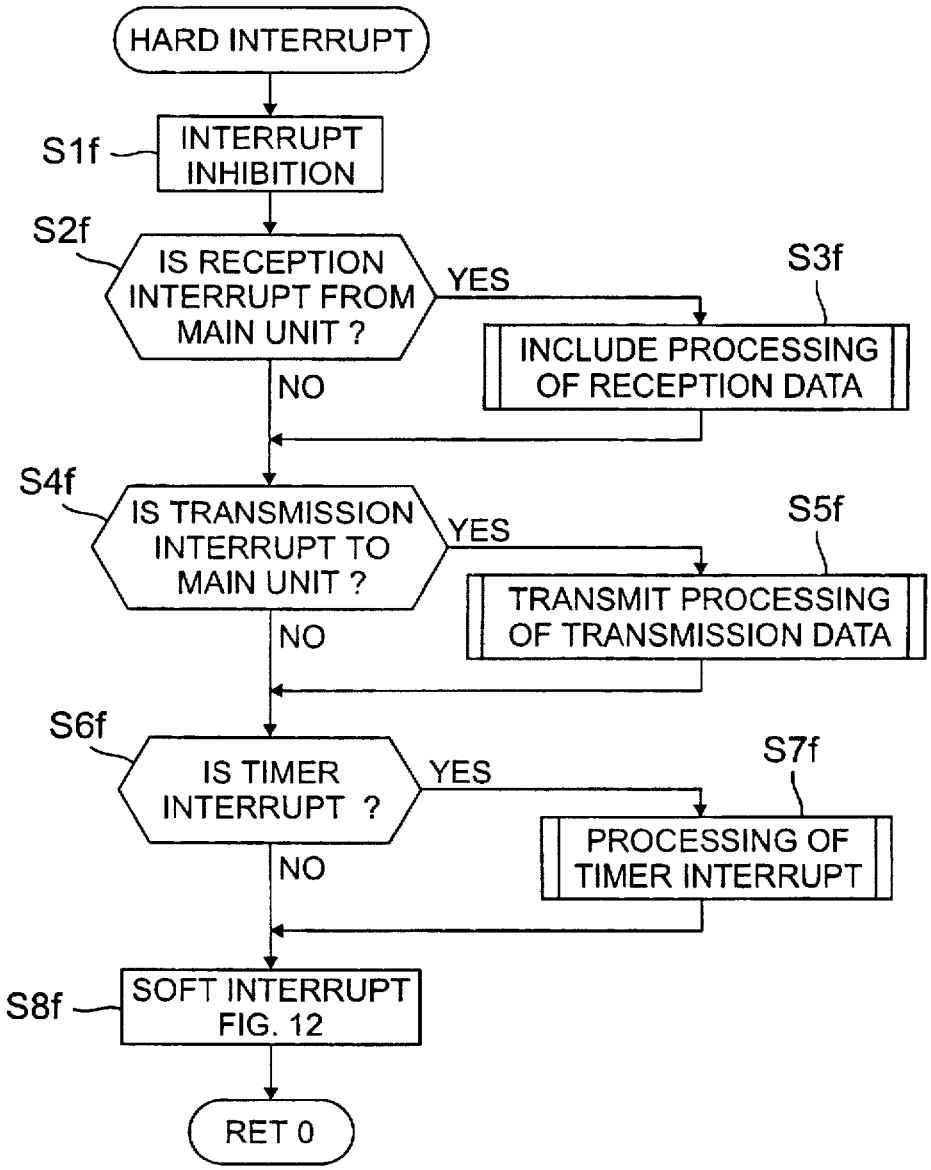
FIG. 15 is a flow chart showing the hard interrupt from the display unit.

After a predetermined lapse of the operation start of the display unit, an operation status input mode flag is automatically set by a timer interrupt (FIG. 15). After completion of the timer interruption processing, a judgement step S1*e* shown in FIG. 14 is performed and the operation status input mode processing routine is executed at step S2*e*. During this routine, the graphics image data for the operation status input display image are written in the video RAM, and thereafter the flow returns to the loop start point at step S3*d*. Next, at steps S3*d* and S5*d*, the display unit CPU transfers the graphics image data for the operation status input display image to the display screen to display it. Then, the display unit CPU stops. An operator depresses a setting key for the jib step while monitoring the display image, and the jib setting data are read by the display unit CPU. Next, the display unit CPU modifies the graphics image data in the video RAM in accordance with the jib step setting data. The graphics data for the input operation status which were modified and stored in the video RAM are then displayed on the screen at steps S3*d* and S5*d*.

The mode processing at step S2*e* performs the above-described display image processing as well as other processing such as storing the transmission data of the main unit in the temporary storage area.

The contents of processing at steps S3*e* to S14*e* are different for each mode.

The key data is read at a predetermined time interval by using the timer interrupt, and when a key is depressed, the corresponding processing is executed.

The soft interrupt flow for the display unit has the same sequence as the main unit soft interrupt flow shown in FIG. 12, although the contents of each step are different.

(3) Contents of Each Processing

The contents of the reception and transmission processing are each divided into the following three processes.

Reception Processing (1): Serial data sent from the main (display) unit are sequentially stored in a designated buffer area. When one block data are received, the data are checked and if they are not abnormal, a start flag at Reception Processing (2) is set. This reception processing is effected by a hard interrupt shown in FIGS. 11 and 15.

Reception Processing (2): The contents of the one block data sent from the main (display) unit are checked and stored in a predetermined memory storage area at an address which the CPU can access. This reception processing is executed by the soft interrupt 1 processing at step S5*c* shown in FIG. 12.

Reception Processing (3): The final processing is executed from the data sent from the main (display) unit and stored in the memory. This reception processing is executed by the soft interrupt 2 processing at step S12*c* shown in FIG. 12 or by the reception data processing at step S3*a* in the main flow shown in FIG. 10.

Transmission Processing (1): It is checked if there are data to be transmitted to the main (display) unit. If there are data, the data are designated as being transmitted and the transmission processing (2) is activated. This transmission processing is executed at step S3*a* of the main flow shown in FIG. 10 or at step S12*c* shown in FIG. 12.

Transmission Processing (2): It is checked if a transmission is enabled. If enabled, the transmission data are read from the memory storage area where they are stored, converted into serial data which are then stored in a memory transmission area, and the transmission processing (3) is activated. This transmission processing is executed by the soft interrupt 1 processing at step S5*c* shown in FIG. 12.

Transmission Processing (3): The data in the memory transmission area are sequentially and serially transmitted.

This transmission processing is executed at step S7*b* for the data transmission processing shown in FIG. 11.

As seen from FIG. 13, the data transmission/reception processing by the display unit is not included in the main flow, but the data transmission/reception is executed at the soft interrupt 1 processing. The reason why the main flow of the main unit includes the transmission/reception processing is as follows. The main task of the main unit is the arithmetic operation and automatic stop operation. So long as these operations are included in the main flow, there is no harm if the data sent from the display unit are soft-interrupted, but there is harm if the arithmetic operation and automatic stop operation of the main unit are delayed in their processing. Since the arithmetic operation takes a long time and there are a number of data required for the arithmetic operation, it is better that the arithmetic operation and automatic stop operation are carried out not by the soft interrupt routine but by the main flow. On the other hand, the display unit executes the transmission/reception processing not by the main flow but by the soft interrupt routine. Since the processing time of panel switch actuation by an operator differs greatly for each mode and the data from the main unit are used by the soft interrupt processing, it is better that the reception processing is executed by the soft interrupt routine.

Also, since the data sent from the main unit are not generated at the main flow but rather are sent as panel switch data, it is better that the transmission processing is executed not by the main flow but by the soft interrupt routine. From the above reasons of different contents of the processing by the main and display units, the transmission/reception processing is executed differently between the main unit and display unit.

The timer interrupt is generated every 10 ms at the main unit. There is also provided a soft timer of 16 channels. 8 channels are used for the soft timer of the soft interrupt 1, and the other 8 channels are used as the soft timer of the soft interrupt 2. A soft timer is constructed of a timer start/stop flag, operation counter and repetition counter. The operation counter and respective counter of the soft timer for the soft interrupt 1 each are constructed of one byte, and those for the soft interrupt 2 of two bytes. The timer start/stop flag is used for the control of the soft timer operation. The flag for the soft interrupt 1 has one byte (8 bits) each bit corresponding to one of the eight timers. Each soft timer operates while the flag bit is "1", and stops while the flag bit is "0". For example, after one of the bits of the timer start/stop flag becomes "1", the operation counter is decremented by 1 each time a hard timer interrupt occurs. When the operation counter becomes "0" which means a time-out, the flag for the soft interrupt 1 or 2 is set and the operation counter is then set with the count data of the repetition counter. This operation repeats until the timer start/stop flag becomes "0". Therefore, the soft interrupt 1 timer can be set for the time duration from 10 ms to 1.55 sec, and the soft interrupt 2 timer can control for the time duration from 50 ms to 54.6125 min.

Figure 16:
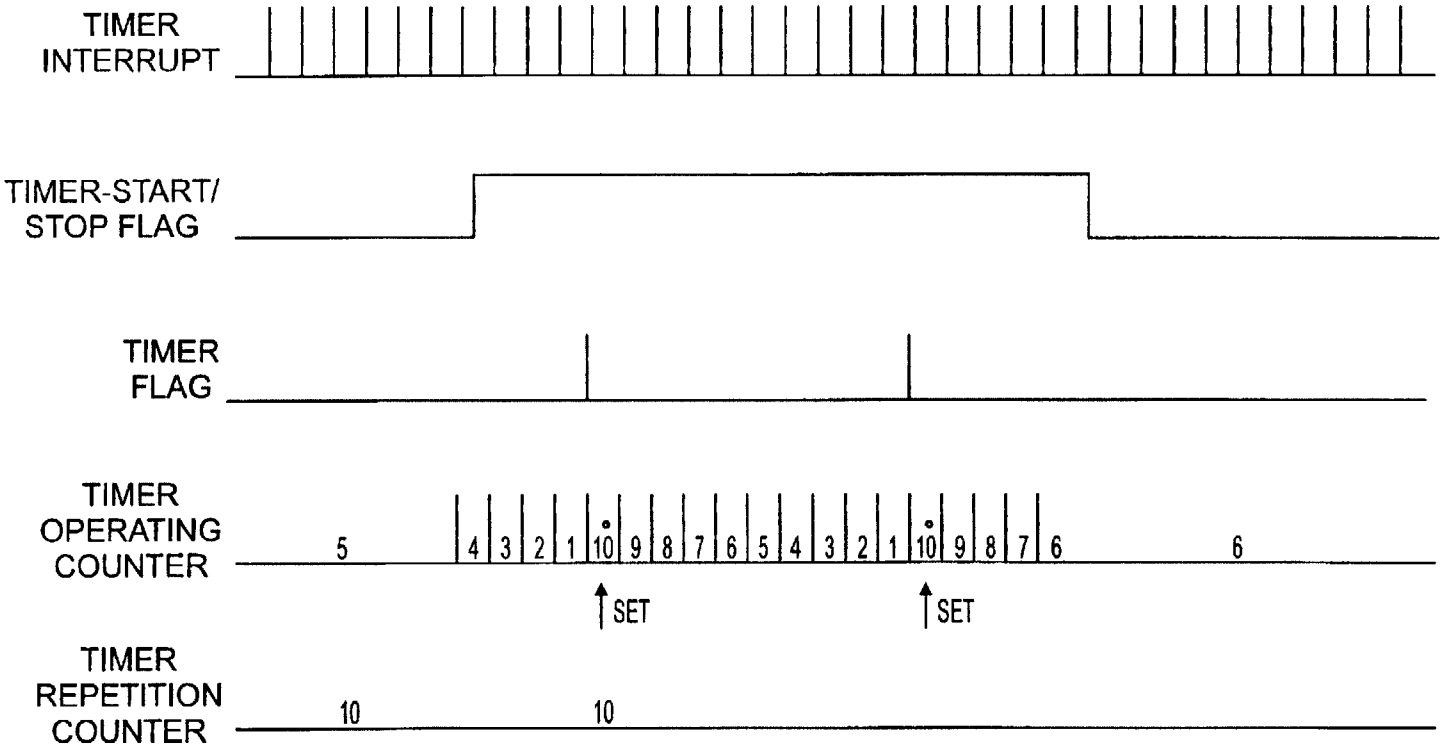
FIG. 16 is a timing chart for signals related to timer interrupt.

This soft timer interrupt is used in the following manner. The display unit receives panel switch data at a time prior to the predetermined time. The display unit also sets the display refresh flag, display flashing flag, initial routine timer, and the like. The main unit sets a voice timer, initial routine timer, communication error check timer and the like. If the timer repetition counter value is 10 and the timer operation counter counts down from the first value, then the timer flag is set after about 5 x (timer interrupt period) after the timer start/stop flag was set. Thereafter, the flag is repetitively set at the interval of about 10 x (timer interrupt period) until the timer start/stop flag is reset. The timer flag signal shown in FIG. 16 is the flag for the soft interrupt 1 or 2. This flag is reset at the time when the corresponding processing is executed.

In the disclosed invention, the term "crane" is used to mean not only a vehicle mounted mechanism but also other mechanisms for generally lifting a load with a boom, such as a vehicle operating on an elevated stage for moving a mount type operation crane or bucket up and down, and right and left.

We claim:

1. A crane safety operation display apparatus for use with a crane mechanism having a crane structure with a boom and at least one outrigger mounted thereon to aid in preventing the crane mechanism from overturning, comprising:

a plurality of sensors connected to the crane mechanism for generating crane status signals at predetermined intervals that correspond to crane mechanism parameters such as boom length, boom angle, and slewing angle;

means for generating an outrigger status signal;

an operation limit memory for storing crane operation limit data;

display means having a two-dimensional screen and a display memory, wherein the display means utilizes data in the display memory to produce a boom diagram depicting a boom extending from a fixed point on the screen;

means for selectively generating a plurality of crane operating modes on said display means;

key means having a plurality of keys for selectively generating either a slewing angle display mode signal or a boom work zone display mode signal; and control means connected to each of the respective sensors, the display means, the outrigger status signal generating means and the key means, and responsive to the crane status signals for generating display data and for loading the generated display data into the display memory, and wherein the control means in response to a crane outrigger status signal accesses the crane operation limit data in the limit memory and calculates boom safety slewing display data which automatically varies with changes in the status of the outrigger, wherein the calculated boom safety slewing display data is loaded into the display memory and in response to the slewing angle display mode signal the control means instructs the display means to display a boom safety slewing area diagram simultaneously with the boom diagram on the screen for viewing, wherein the boom safety slewing area diagram is a closed curved line displaying boom safety slewing limits for safe operation of the crane mechanism about the fixed point, whereby an operator can determine from the screen if the boom diagram is within the boom safety slewing area diagram which indicates that the crane mechanism is not in danger of overturning to ensure safe crane operation, and the control means in response to the boom work zone display mode signal instructs the display means to display the boom diagram on the screen, and responsive to a boom work zone instruction generated upon key actuation of the key means by an operator, a stationary boom operation range limit zone pattern is displayed simultaneously with the boom diagram on the screen for viewing.

2. A crane operation display apparatus according to claim 1, wherein the boom safety slewing display data is calculated at predetermined intervals and the display data for the boom safety slewing area diagram is produced from the calculated boom safety slewing display data to update the boom safety slewing area diagram displayed on the screen.

* * * * *